US008709689B2

(12) United States Patent
Fujii

(10) Patent No.: US 8,709,689 B2
(45) Date of Patent: Apr. 29, 2014

(54) ELECTROPHOTOGRAPHIC PHOTORECEPTOR, IMAGE-FORMING APPARATUS, AND ELECTROPHOTOGRAPHIC CARTRIDGE

(75) Inventor: Akiteru Fujii, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 13/586,003

(22) Filed: Aug. 15, 2012

(65) Prior Publication Data

US 2013/0052574 A1 Feb. 28, 2013

(30) Foreign Application Priority Data

Aug. 26, 2011 (JP) ..... 2011-184858

(51) Int. Cl.
*G03G 5/00* (2006.01)

(52) U.S. Cl.
USPC ..... 430/58.35; 399/159

(58) Field of Classification Search
USPC ..... 430/58.35; 399/159
See application file for complete search history.

(56) References Cited

U.S. PATENT DOCUMENTS

| | | | |
|---|---|---|---|
| 4,982,014 A | 1/1991 | Freitag et al. | |
| 5,126,428 A | 6/1992 | Freitag et al. | |
| 5,227,458 A | 7/1993 | Freitag et al. | |
| 5,312,708 A | 5/1994 | Terrell et al. | |
| 5,449,572 A | 9/1995 | Ashiya et al. | |
| 5,554,473 A | 9/1996 | Cais et al. | |
| 6,001,523 A | 12/1999 | Kemmesat et al. | |
| 6,749,979 B2 | 6/2004 | Takeuchi et al. | |
| 2006/0147823 A1* | 7/2006 | Kobayashi et al. | 430/58.85 |
| 2010/0209136 A1* | 8/2010 | Mizushima et al. | 399/111 |

FOREIGN PATENT DOCUMENTS

| | | |
|---|---|---|
| EP | 0 767 411 A1 | 4/1997 |
| JP | 2-88634 | 3/1990 |
| JP | 5-289374 | 11/1993 |
| JP | 6-75389 | 3/1994 |
| JP | 7-271063 | 10/1995 |
| JP | 8-220783 | 8/1996 |
| JP | 9-171263 | 6/1997 |
| JP | 9-204053 | 8/1997 |
| JP | 10-207085 | 8/1998 |
| JP | 2000-19752 | 1/2000 |
| JP | 3144117 | 1/2001 |
| JP | 2001-330972 | 11/2001 |
| JP | 3629574 | 12/2004 |

* cited by examiner

*Primary Examiner* — Mark A Chapman
(74) *Attorney, Agent, or Firm* — Oblon, Spivak, McClelland, Maier & Neustadt, L.L.P.

(57) ABSTRACT

The invention can provide an electrophotographic photoreceptor comprising a photosensitive layer containing a specific charge transport material and a specific copolymerized polycarbonate resin, and an image-forming apparatus and an electrophotographic cartridge which use the electrophotographic photoreceptor.

14 Claims, 1 Drawing Sheet

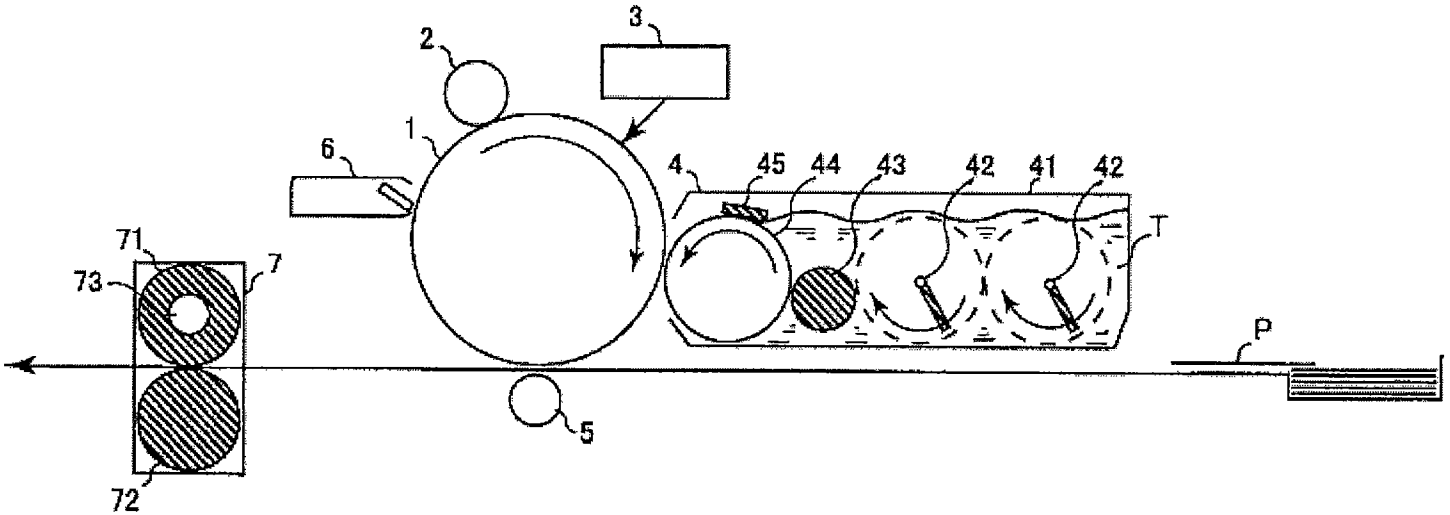
1
2
3
4
5
6
7
41
42
42
43
44
45
71
72
73
T
P

ELECTROPHOTOGRAPHIC PHOTORECEPTOR, IMAGE-FORMING APPARATUS, AND ELECTROPHOTOGRAPHIC CARTRIDGE

FIELD OF INVENTION

The present invention relates to an electrophotographic photoreceptor, an image-forming apparatus and a cartridge, which are used in copiers, printers and the like. More specifically, the present invention relates to an electrophotographic photoreceptor, an image-forming apparatus and a cartridge, ensuring that even when an inexpensive polycarbonate resin of general-purpose grade is used as the binder resin for photoreceptor, by combining it with a specific charge transport material, excellent performance is exerted in terms of electrical characteristics, image characteristics, abrasion resistance and the like.

BACKGROUND OF INVENTION

Electrophotography is widely used in copiers, printers and printing machines, because, for example, a high-quality image is instantaneously obtained.

As for the electrophotographic photoreceptor (hereinafter, sometimes referred to as "photoreceptor"), which serves as the core of electrophotography, a photoreceptor using an organic photoconductive substance having advantages such as no pollution, ease of deposition, and ease of production is widely employed.

As the binder resin used for the electrophotographic photoreceptor, a bisphenol-A-polycarbonate has been conventionally used, but since the life (pot life) of the coating solution is short due to high crystallinity and the mechanical properties such as abrasion resistance are insufficient, this resin is scarcely used at present. Instead, it is a mainstream to use a specific polycarbonate such as bisphenol-Z-polycarbonate and bisphenol-C-polycarbonate, alone or by mixing it with other resins or copolymerizing it with other bisphenol components.

However, unlike bisphenol-A-polycarbonate, it is rare for such a specific polycarbonate to be widely used in other applications for general purposes, and therefore, the merit for mass production is small, giving rise to a drawback that the cost of the resin is very high. Furthermore, in using a binder resin for an electrophotographic photoreceptor, performances not required in other general-purpose applications, such as performance not impairing electrical characteristics, are generally required and the quality must be strictly checked for each production lot, which is disadvantageous in that the production by a large-scale continuous production system has a high risk and batch production at a relatively small scale is obliged.

Recently, in addition to bisphenol-A-polycarbonate, a polycarbonate resin obtained by copolymerizing a bisphenol component such as bisphenol A and a bisphenol component having an alkyl-substituted cycloalkyl component such as isophorone (see, Patent Document 1, hereinafter referred to as isophorone-based polycarbonate resin) is put into use in other applications for general purposes and is available at a relatively low cost. Moreover, this resin is soluble in an organic solvent used in the coating solution for the electrophotographic photoreceptor and has low crystallinity and therefore, the life of the coating solution is greatly improved as compared with bisphenol-A-polycarbonate.

DOCUMENT LIST

[Patent Document 1] JP-A-2-88634 (the term "JP-A" as used herein means an "unexamined published Japanese patent application")

[Patent Document 2] Japanese Patent No. 3629574

[Patent Document 3] Japanese Patent No. 3144117

[Patent Document 4] JP-A-8-220783

[Patent Document 5] JP-A-6-75389

[Patent Document 6] JP-A-9-204053

SUMMARY OF THE INVENTION

However, the isophorone-based polycarbonate resin is a resin mass-produced for the general-purpose applications and therefore, although not becoming a problem in other applications, the resin has various problems in the quality when using it for an electrophotographic photoreceptor and, despite studies as in Patent Documents 2 to 6, has not reached commercialization because of weakness particularly in the residual potential (bright potential) at the initial stage as well as during durable use, the image characteristics such as image memory, and the abrasion resistance.

As a result of intensive studies to solve the above-described problems, the present inventors have found that those problems can be solved by combining an isophorone-based polycarbonate resin with a specific charge transport material. The present invention has been accomplished based on this finding.

That is, the gist of the present invention resides in the following [1] to [5].

[1] An electrophotographic photoreceptor comprising a photosensitive layer containing at least one charge transport material represented by the following formula (1) or (2) and a copolymerized polycarbonate resin having repeating units represented by the following formulae (3) and (4):

(1)

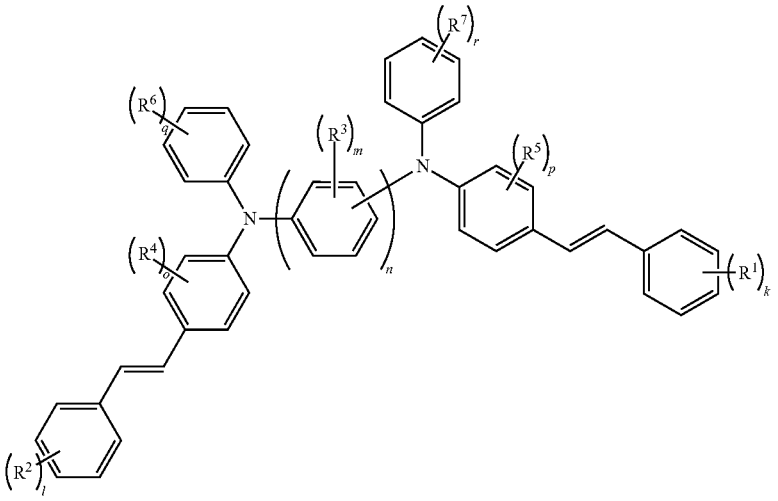

wherein each of $R^1$ to $R^7$ independently represents a hydrogen atom, an alkyl group, an aryl group or an alkoxy group, n represents an integer of 1 to 3, each of k, l, q and r independently represents an integer of 1 to 5, and each of m, o and p independently represents an integer of 1 to 4;

(2)

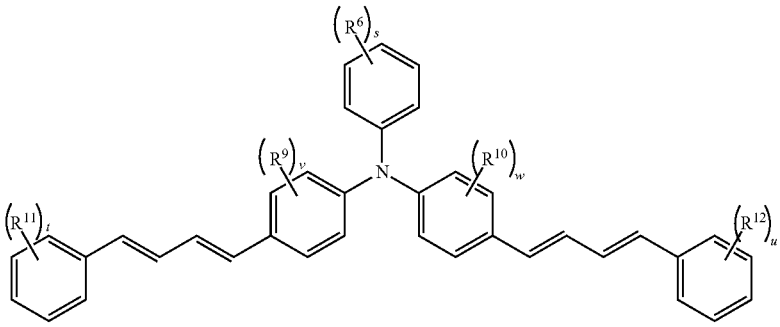

wherein each of $R^8$ to $R^{12}$ independently represents a hydrogen atom, an alkyl group, an aryl group or an alkoxy group, each of s, t and u represents an integer of 1 to 5, and each of v and w represents an integer of 1 to 4;

(3)

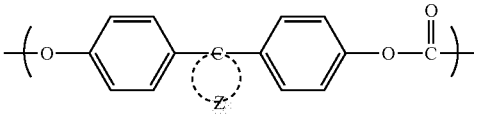

wherein Z forms a cyclic saturated aliphatic alkyl group having a carbon number of 5 to 8 including the carbon atom bonded thereto, and the cyclic saturated aliphatic alkyl group has from 1 to 3 methyl groups as the substituent;

(4)

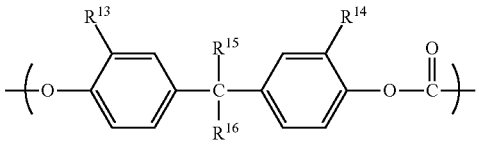

wherein each of $R^{13}$ to $R^{16}$ independently represents a hydrogen atom or a methyl group.

[2] The electrophotographic photoreceptor as claimed in the item [1], wherein said copolymerized polycarbonate resin is represented by the following structural formula (5):

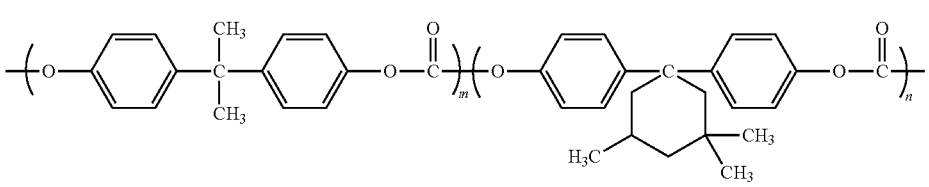

(5)

wherein m and n represent a molar ratio, and m:n=from 90:10 to 10:90.

[3] The electrophotographic photoreceptor as claimed in the item [1] or [2], wherein the amount of said charge transport material used is from 20 to 70 parts by mass per 100 parts by mass of said copolymerized polycarbonate resin.

[4] An image-forming apparatus forming an image by using the electrophotographic photoreceptor claimed in any one of the items [1] to [3], the image-forming apparatus comprising: a charging portion of charging the electrophotographic photoreceptor; an exposure portion of exposing said charged electrophotographic photoreceptor to light to form an electrostatic latent image; a development portion of developing said electrostatic latent image with a toner; a transfer portion of transferring said toner to a receiving object; and a cleaning portion.

[5] An electrophotographic cartridge comprising the electrophotographic photoreceptor claimed in any one of the items [1] to [3].

According to the present invention, it is possible to obtain an electrophotographic photoreceptor which is, even in the case of using an isophorone-based polycarbonate resin, excellent in the residual potential at the initial stage as well as during durable use, the image characteristics such as image memory, and the abrasion resistance. An image-forming apparatus and an electrophotographic cartridge each using the same can be also obtained.

BRIEF DESCRIPTION OF THE DRAWINGS

FIG. 1 is a schematic view illustrating the configuration of main parts in one embodiment of the image-forming apparatus of the present invention.

DESCRIPTION OF REFERENCE NUMERALS AND SIGNS

1 Photoreceptor

2 Charging device (charging roller)

3 Exposing device

4 Developing device

5 Transfer device

6 Cleaning device

7 Fixing device

41 Developing tank

42 Agitator

43 Feed roller

44 Developing roller

45 Regulating member

71 Upper fixing member (pressure roller)

72 Lower fixing member (fixing roller)

73 Heating device

T Toner

P Recording paper (paper, medium)

DETAILED DESCRIPTION OF THE INVENTION

The mode for carrying out the present invention is described in detail below. However, the present invention is not limited to the following embodiments and can be performed by arbitrarily making modifications therein without departing from the purport of the invention.

First, the charge transport material and the copolymerized polycarbonate resin, which are used in the electrophotographic photoreceptor of the present invention, are described.

<Charge Transport Material>

As the charge transport material contained in the photosensitive layer of the electrophotographic photoreceptor of the present invention, a hole-transporting material represented by the following general formula (1) or (2) is used:

(1)

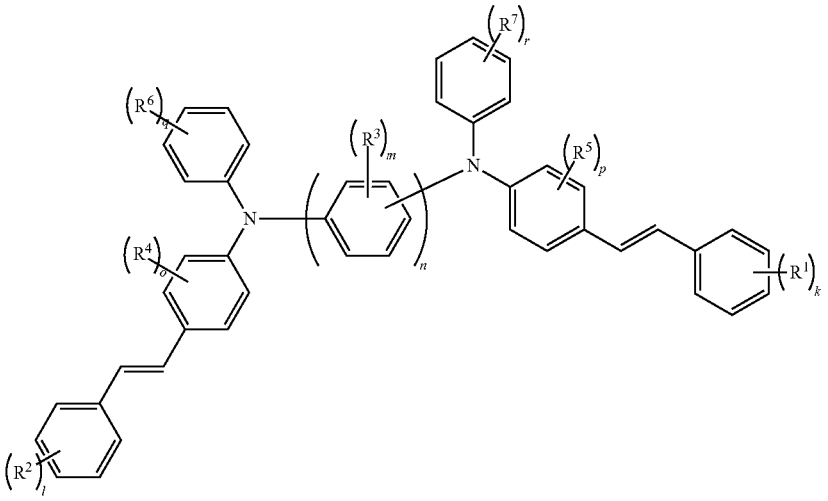

In formula (1), each of $R^1$ to $R^7$ independently represents a hydrogen atom, an alkyl group, an aryl group or an alkoxy group, n represents an integer of 1 to 3, each of k, l, q and r independently represents an integer of 1 to 5, and each of m, o and p independently represents an integer of 1 to 4.

In formula (1), each of $R^1$ and $R^2$ independently represents a hydrogen atom, an alkyl group, an aryl group or an alkoxy group. Specifically, the alkyl group includes a linear alkyl group such as methyl group, ethyl group, n-propyl group and n-butyl group, a branched alkyl group such as isopropyl group and ethylhexyl group, and a cyclic alkyl group such as cyclohexyl group; the aryl group includes, for example, a phenyl group and a naphthyl group, each of which may have a substituent; and the alkoxy group includes a linear alkoxy group such as methoxy group, ethoxy group, n-propoxy group and n-butoxy group, a branched alkyl group such as isopropoxy group and ethylhexyloxy group, and a cyclohexyloxy group. Among others, in view of versatility of the production raw material and charge transportability as the charge transport substance, a hydrogen atom, a methyl group, an ethyl group, a methoxy group or an ethoxy group is preferred. The bonding position of each substituent on the benzene ring may be usually any of the o-position, the m-position and the p-position with respect to the styryl group but in view of ease of production, is preferably either the o-position or the p-position.

In formula (1), each of $R^3$ to $R^5$ independently represents a hydrogen atom, an alkyl group, an aryl group or an alkoxy group. Specifically, the alkyl group includes a linear alkyl group such as methyl group, ethyl group, n-propyl group and n-butyl group, a branched alkyl group such as isopropyl group and ethylhexyl group, and a cyclic alkyl group such as cyclohexyl group; the aryl group includes, for example, a phenyl group and a naphthyl group, each of which may have a substituent; and the alkoxy group includes a linear alkoxy group such as methoxy group, ethoxy group, n-propoxy group and n-butoxy group, a branched alkyl group such as isopropoxy group and ethylhexyloxy group, and a cyclohexyloxy group. Among others, in view of versatility of the production raw material, a hydrogen atom, an alkyl group having a carbon number of 1 to 8, or an alkoxy group having a carbon number of 1 to 8 is preferred; in view of handleability during production, a hydrogen atom, an alkyl group having a carbon number of 1 to 6, or an alkoxy group having a carbon number of 1 to 6 is more preferred; in view of light attenuation properties as the electrophotographic photoreceptor, a hydrogen atom or an alkyl group having a carbon number of 1 to 2 is still more preferred; and in view of charge transportability as the charge transport substance, a hydrogen atom is yet still more preferred.

In formula (1), each of $R^6$ and $R^7$ independently represents a hydrogen atom, an alkyl group, an aryl group or an alkoxy group. Specifically, the alkyl group includes a linear alkyl group such as methyl group, ethyl group, n-propyl group and n-butyl group, a branched alkyl group such as isopropyl group and ethylhexyl group, and a cyclic alkyl group such as cyclohexyl group; the aryl group includes, for example, a phenyl group and a naphthyl group, each of which may have a substituent; and the alkoxy group includes a linear alkoxy group such as methoxy group, ethoxy group, n-propoxy group and n-butoxy group, a branched alkyl group such as isopropoxy group and ethylhexyloxy group, and a cyclohexyloxy group. Among others, in view of versatility of the production raw material, a hydrogen atom, an alkyl group having a carbon number of 1 to 8, or an alkoxy group having a carbon number of 1 to 8 is preferred; in view of handleability during production, a hydrogen atom, an alkyl group having a carbon number of 1 to 6, or an alkoxy group having a carbon number of 1 to 6 is more preferred; in view of light attenuation properties as the electrophotographic photoreceptor, an alkyl group having a carbon number of 1 to 4 or an alkoxy group having a carbon number of 1 to 4 is still more preferred; in view of ozone resistance of the electrophotographic photoreceptor, an alkyl group having a carbon number of 1 to 4 is yet still more preferred; and in view of charge transportability as the charge transport substance, a methyl group or an ethyl group is most preferred. In the case where each of $R^6$ and $R^7$ is an alkyl group or an alkoxy group, the bonding position of each substituent on the benzene ring may be usually any of the o-position, the m-position and the p-position with respect to the bonding of nitrogen atom but in view of ease of production, is preferably either the o-position or the p-position. In the case where the total of alkyl groups and alkoxy groups is 2 or more per one benzene ring, they are preferably substituted on either the o-position or the p-position. In view of electrophotographic photoreceptor characteristics, a case where two alkyl groups in total are substituted on one benzene ring is preferred, and a case where those two substituents are substituted on the p-position and the o-position, respectively, or both are substituted on the o-position, is more preferred.

Each of k, l, q and r independently represents an integer of 1 to 5, and each of m, o and p independently represents an integer of 1 to 4. Each $R^1$ to $R^7$ bonded to the benzene ring may be different from every other $R^1$ to $R^7$, and also in the case where each of k, l, m, o, p, q and r represents an integer of 2 or more, each $R^1$ to $R^7$ bonded to the benzene ring may be different from every other $R^1$ to $R^7$.

n represents an integer of 1 to 3. As the integer is larger, the solubility for a coating solvent tends to decrease. For this reason, n is preferably 1 or 2 and in view of charge transportability as the charge transport substance, more preferably 2.

The arylene group moiety to which a diphenylamino group is bonded represents a phenylene group when n=1, a biphenylene group when n=2, or a terphenylene group when n=3. The position at which two diphenylamino groups are bonded to the arylene group is not particularly limited as long as the effects of the present invention are not seriously impaired, but when n=1, in view of chargeability of the electrophotographic photoreceptor, a relationship where two diphenylamino groups are bonded on the m-position of the phenylene group is preferred; when n=2, in view of charge transportability as the charge transport substance, the bonding position of the diphenylamino group on the phenylene group is preferably 4-position and 4'-position of the biphenylene group; and when n=3, in view of versatility of the production raw material, among terphenylene groups, a p-terphenylene group is preferred and in view of charge transportability as the charge transport substance, the bonding position of the diphenylamine group on the p-terphenylene group is preferably 4-position and 4"-position.

The electrophotographic photoreceptor of the present invention may usually contain the compound represented by formula (1) as a single component or as a mixture of the compounds represented by formula (1) differing in the structure. As for the mixture, a case of mixing a plurality of compounds where only the substitution positions of $R^1$ to $R^7$ are different out of the structure represented by formula (1), so-called positional isomers, is preferred, because electrons are situated close to each other and scarcely serve as a trap of the charge transport and in addition, crystal formation in the coating solution or film can be suppressed. As for the positional isomer, positional isomers differing in the substitution positions of $R^1$ and $R^2$ are preferably mixed and used, and it is most preferred to mix and use positional isomers where the substitution positions of $R^1$ and $R^2$ are the o-position and the p-position.

group, each of s, t and u represents an integer of 1 to 5, and each of v and w represents an integer of 1 to 4.

In formula (2), $R^8$ represents any one of a hydrogen atom, an alkyl group, an aryl group and an alkoxy group. Specifically, the alkyl group includes a linear alkyl group such as methyl group, ethyl group, n-propyl group and n-butyl group, a branched alkyl group such as isopropyl group and ethylhexyl group, and a cyclic alkyl group such as cyclohexyl group; the aryl group includes, for example, a phenyl group and a naphthyl group, each of which may have a substituent; and the alkoxy group includes a linear alkoxy group such as methoxy group, ethoxy group, n-propoxy group and n-butoxy group, a branched alkyl group such as isopropoxy group and ethylhexyloxy group, and a cyclohexyloxy group. Among others, in view of versatility of the production raw material, a hydrogen atom, an alkyl group having a carbon number of 1 to 8, or an alkoxy group having a carbon number of 1 to 8 is preferred; in view of handleability during production, a hydrogen atom, an alkyl group having a carbon number of 1 to 6, or an alkoxy group having a carbon number of 1 to 6 is more preferred; in view of light attenuation properties as the electrophotographic photoreceptor, an alkyl group having a carbon number of 1 to 4 or an alkoxy group having a carbon number of 1 to 4 is still more preferred; in view of ozone resistance of the electrophotographic photoreceptor, an alkyl group having a carbon number of 1 to 4 is yet still more preferred; and in view of solubility, a linear or branched alkyl group having a carbon number of 3 to 4 is most preferred. In the case where $R^8$ is an alkyl group, the bonding position of the substituent on the benzene ring may be usually any of the o-position, the m-position and the p-position with respect to the bonding of nitrogen atom but in view of ease of production, is preferably the o-position or the p-position.

In formula (2), each of $R^9$ and $R^{10}$ independently represents a hydrogen atom, an alkyl group, an aryl group or an alkoxy group. Specifically, the alkyl group includes a linear alkyl group such as methyl group, ethyl group, n-propyl group and n-butyl group, a branched alkyl group such as isopropyl group and ethylhexyl group, and a cyclic alkyl group such as cyclohexyl group; the aryl group includes, for example, a phenyl group and a naphthyl group, each of which may have a substituent; and the alkoxy group includes a linear alkoxy group such as methoxy group, ethoxy group, n-propoxy group and n-butoxy group, a branched alkyl group such as isopropoxy group and ethylhexyloxy group, and a cyclohexyloxy group. Among others, in view of versatility of the production raw material, a hydrogen atom, an alkyl group having a carbon number of 1 to 8, or an alkoxy group having (2)

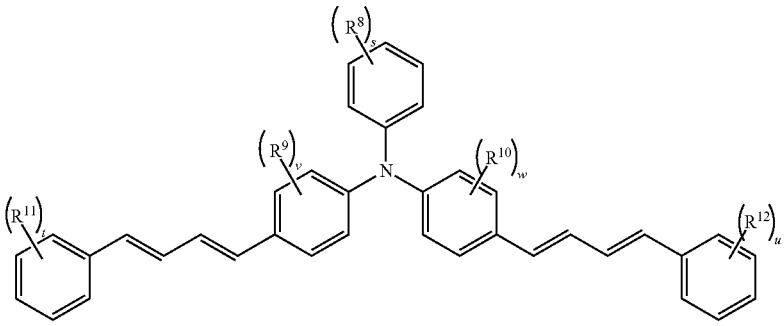

In formula (2), each of $R^8$ to $R^{12}$ independently represents a hydrogen atom, an alkyl group, an aryl group or an alkoxy a carbon number of 1 to 8 is preferred; in view of handleability during production, a hydrogen atom, an alkyl group having a carbon number of 1 to 6, or an alkoxy group having a carbon number of 1 to 6 is more preferred; in view of light attenuation properties as the electrophotographic photoreceptor, a hydrogen atom or an alkyl group having a carbon number of 1 to 2 is still more preferred; and in view of charge transportability as the charge transport substance, a hydrogen atom is yet still more preferred.

In formula (2), each of $R^{11}$ and $R^{12}$ independently represents a hydrogen atom, an alkyl group, an aryl group and an alkoxy group. Specifically, the alkyl group includes a linear alkyl group such as methyl group, ethyl group, n-propyl group and n-butyl group, a branched alkyl group such as isopropyl group and ethylhexyl group, and a cyclic alkyl group such as cyclohexyl group; the aryl group includes, for example, a phenyl group and a naphthyl group, each of which may have a substituent; and the alkoxy group includes a linear alkoxy group such as methoxy group, ethoxy group, n-propoxy group and n-butoxy group, a branched alkyl group such as isopropoxy group and ethylhexyloxy group, and a cyclohexyloxy group. Among others, in view of versatility of the production raw material and charge transportability as the charge transport substance, a hydrogen atom, a methyl group, an ethyl group, a methoxy group or an ethoxy group is preferred. The bonding position of each substituent on the benzene ring may be usually any of the o-position, the m-position and the p-position with respect to the styryl group but in view of ease of production, is preferably either the o-position or the p-position.

Examples of the structure of the charge transport substance suitable for the present invention are shown below, but the following structures are examples for more specifically illustrating the present invention and the present invention is not limited to these structures as long as the concept of the present invention is observed.

(1)-1

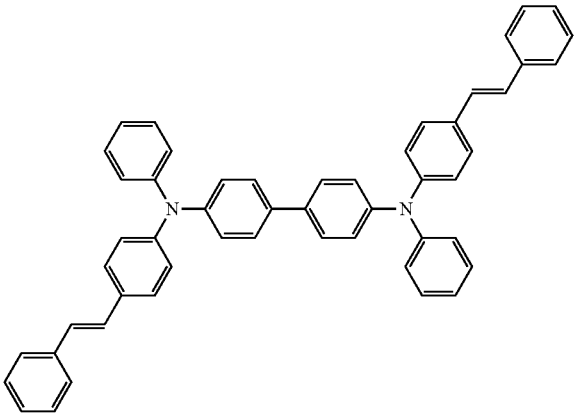

(1)-2

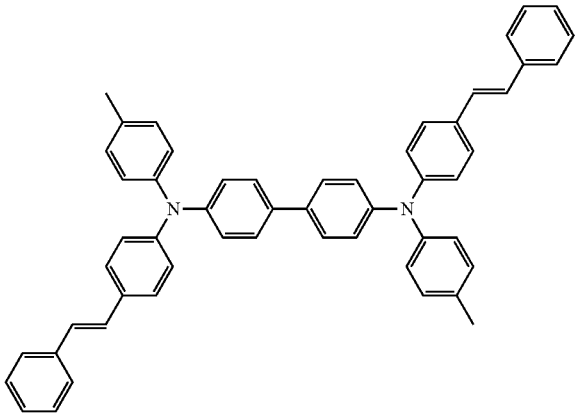

(1)-3

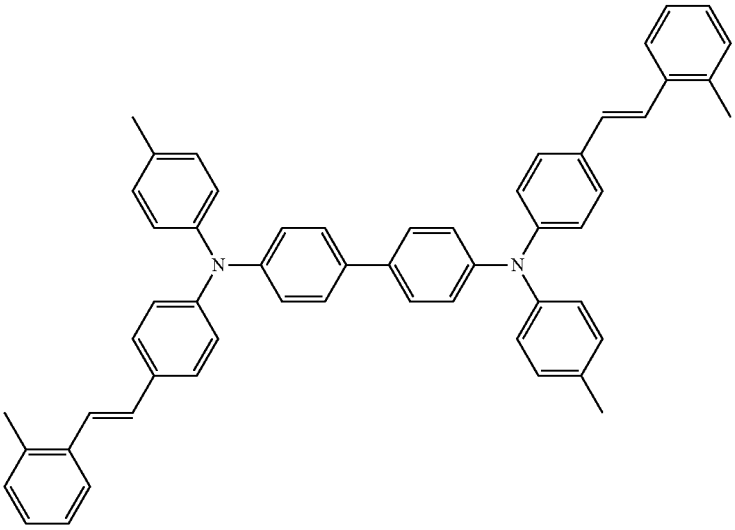

-continued
(1)-4
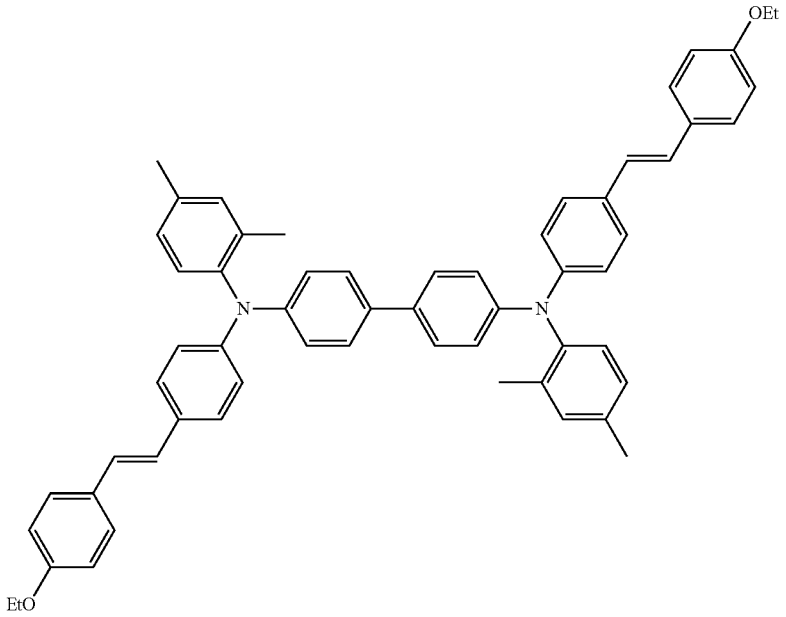
(1)-5
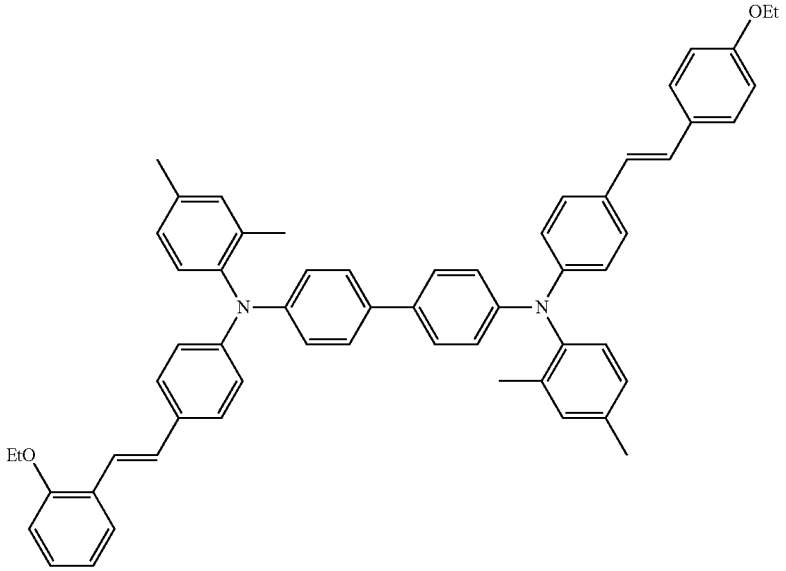

-continued
(1)-6
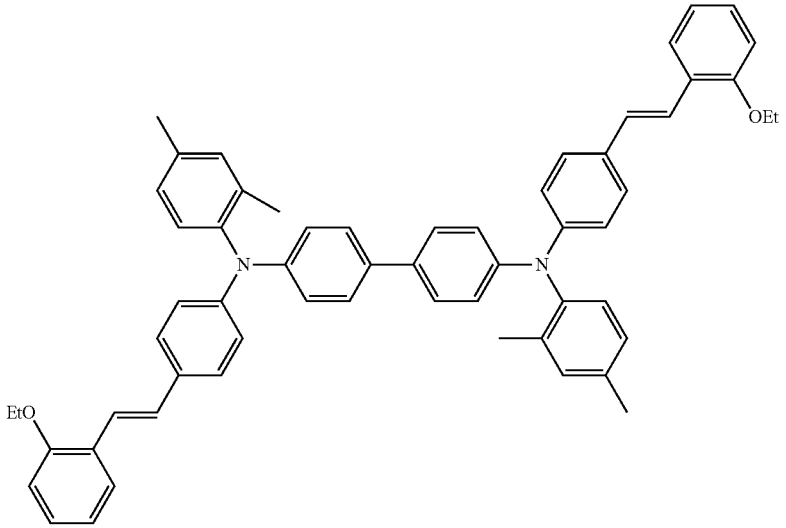
(1)-7
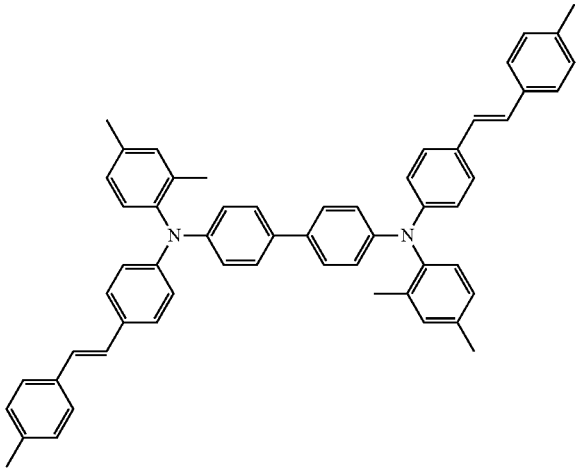
(1)-8
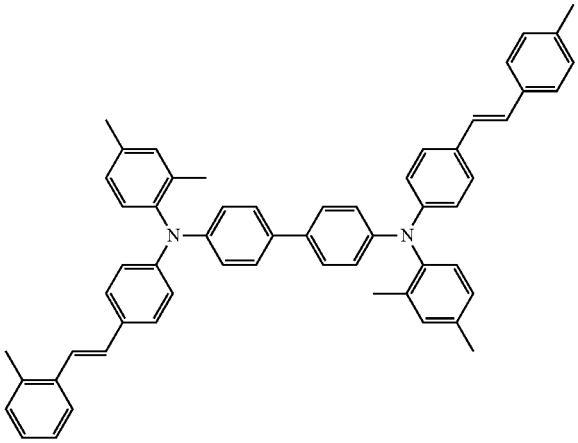
(1)-9
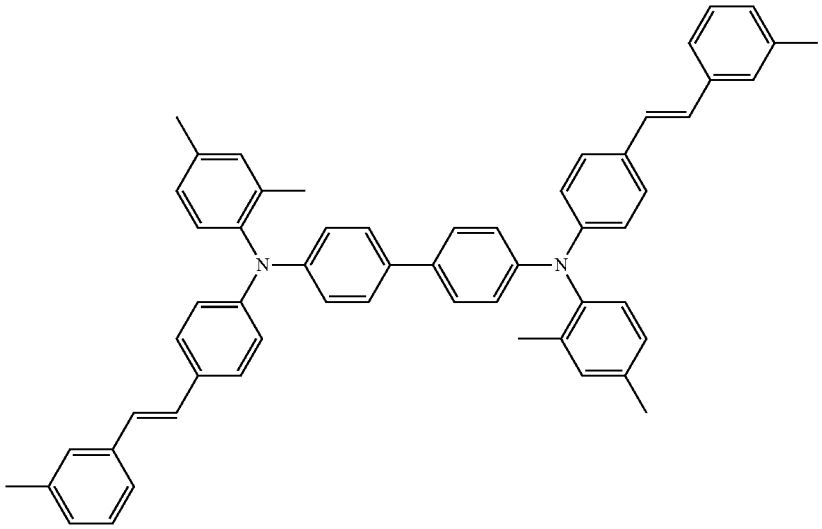

-continued
(1)-10
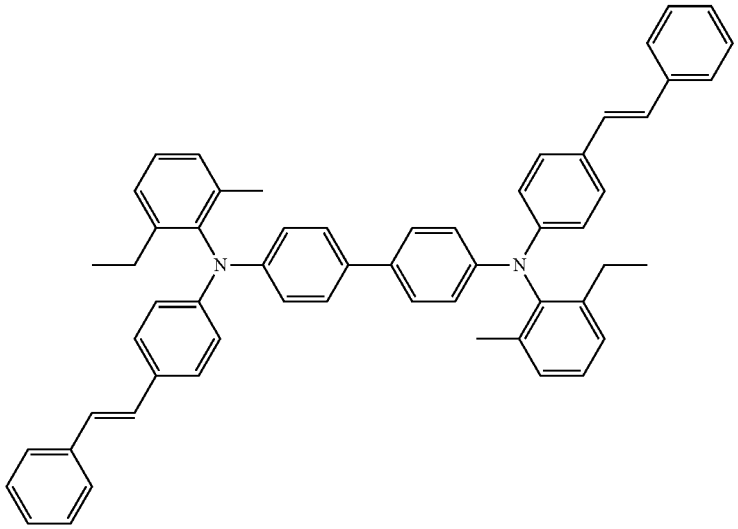
(1)-11
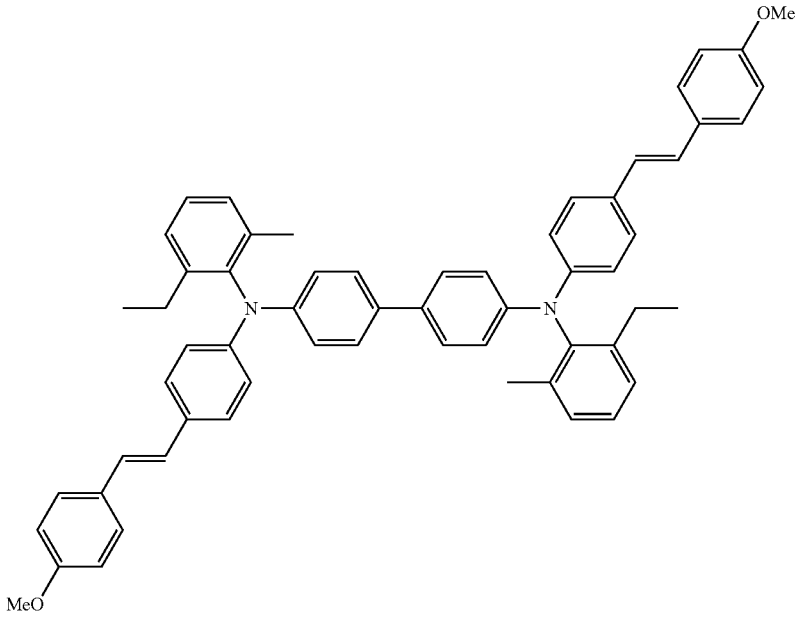
(1)-12
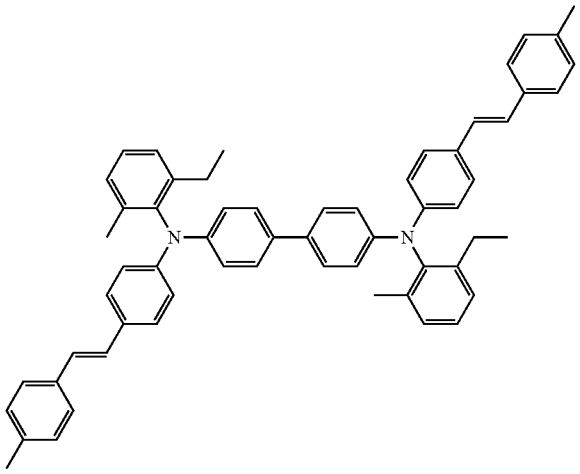
(1)-13
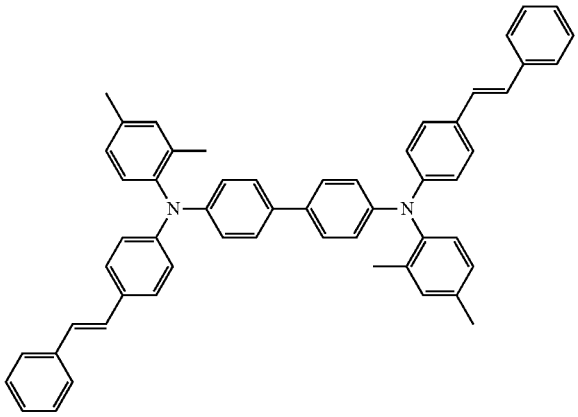

-continued
(1)-14
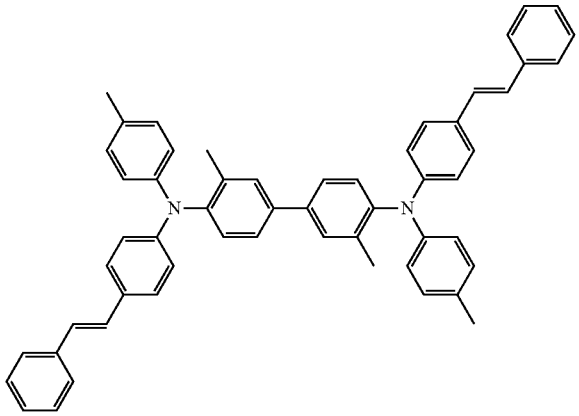
(1)-15
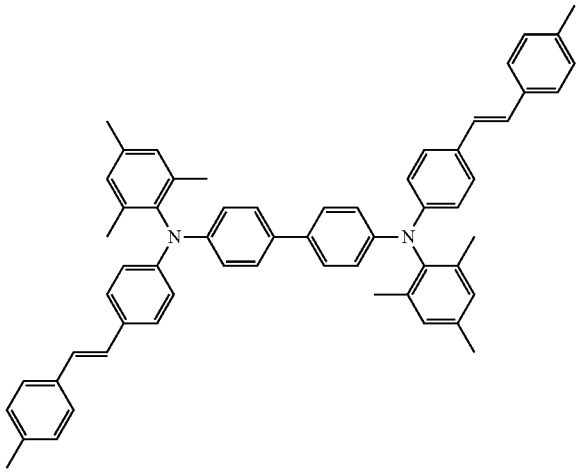
(1)-16
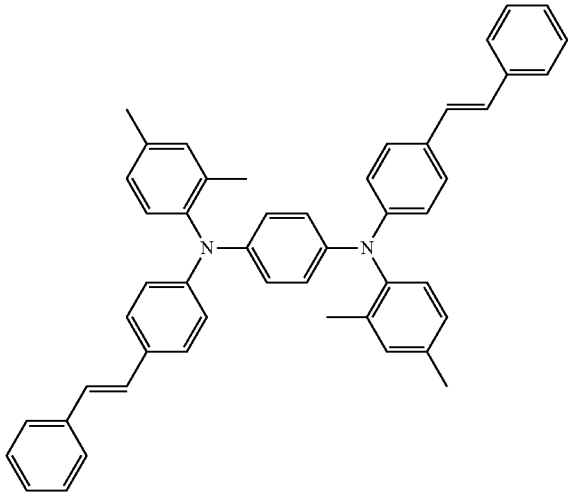
(1)-17
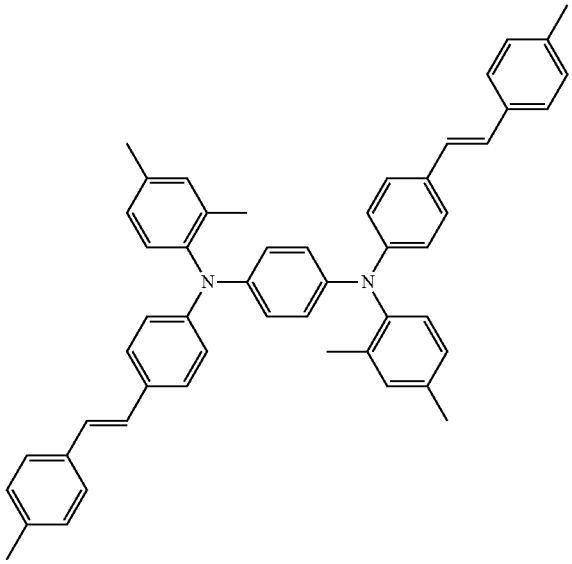

-continued
(1)-18
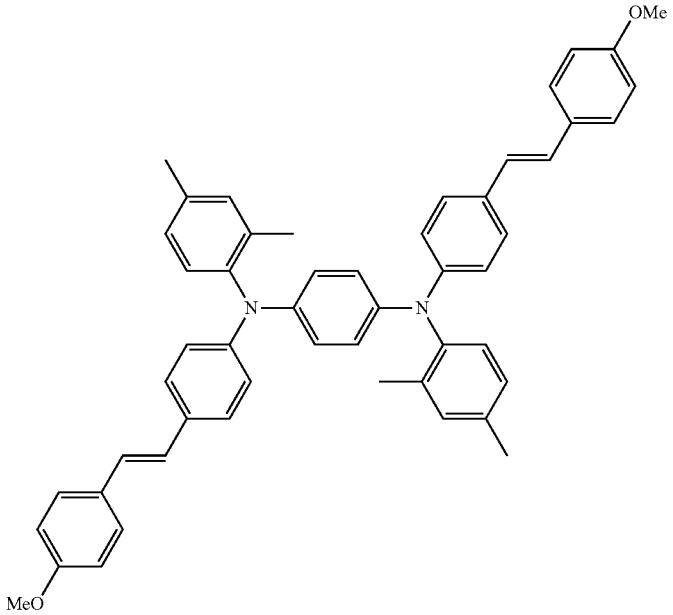
(1)-19
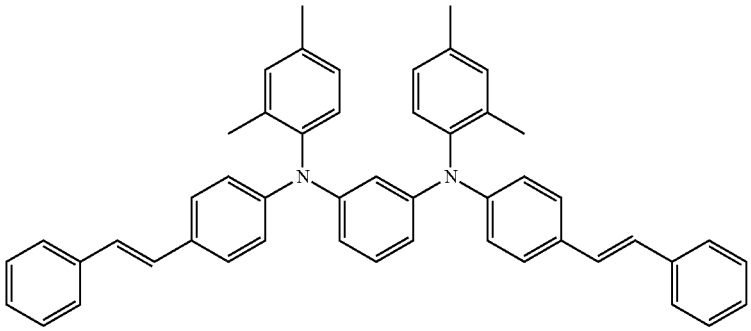
(1)-20
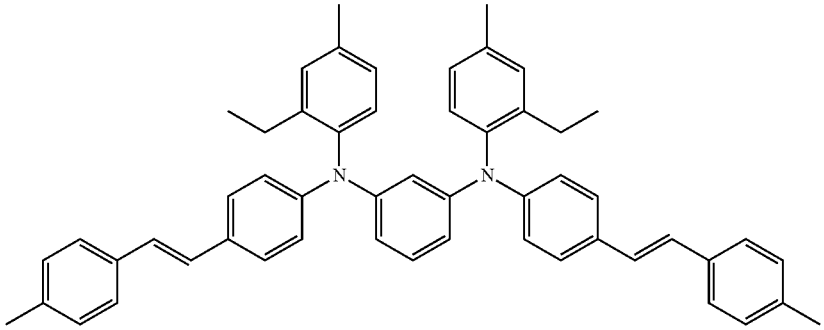
(1)-21
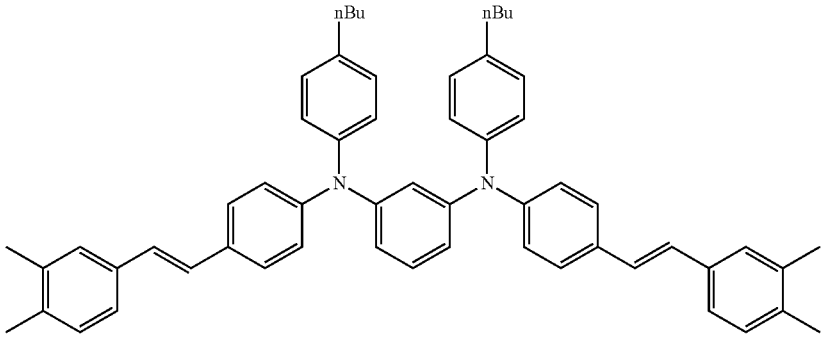

-continued
(1)-22
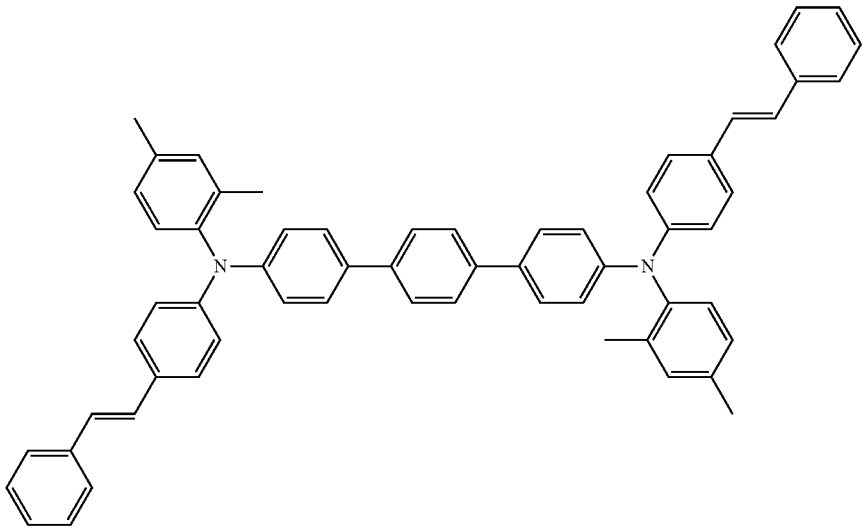
(1)-23
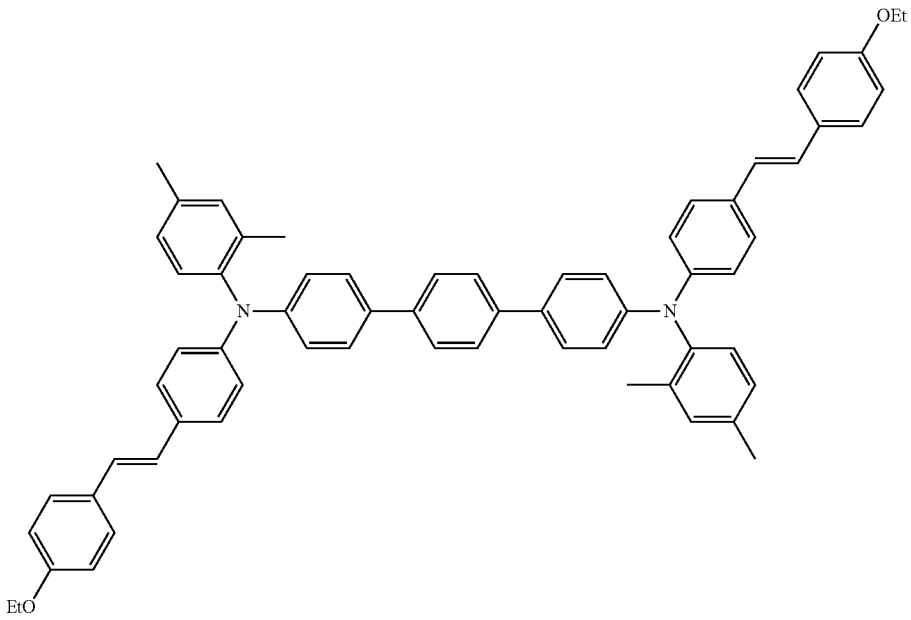

-continued
(1)-24
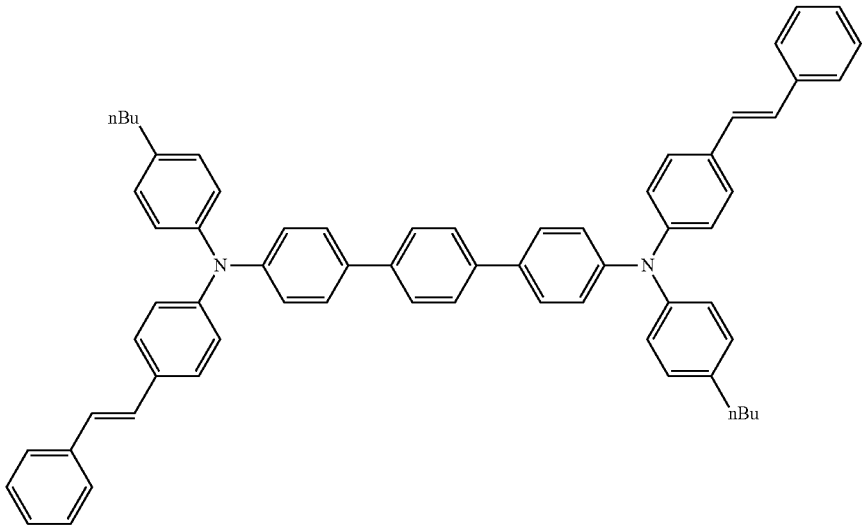
(1)-25
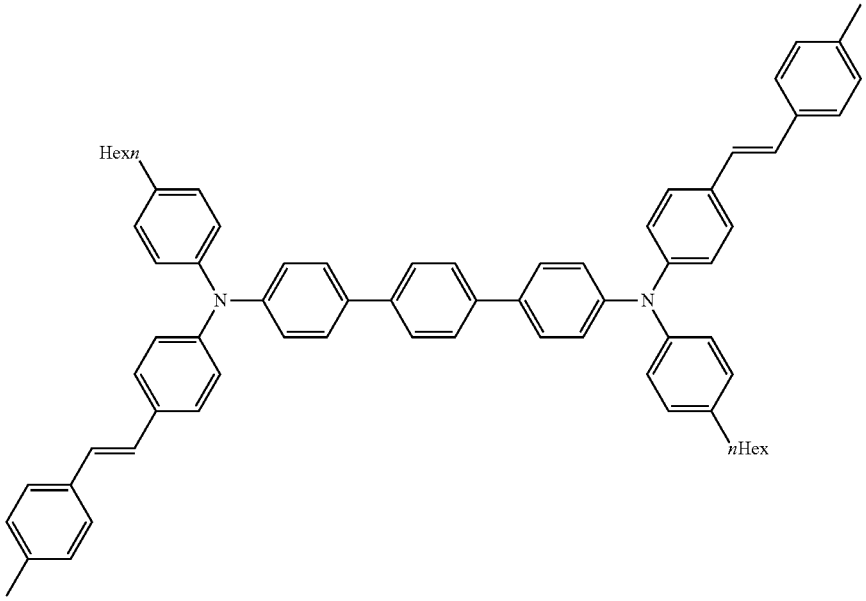
(1)-26
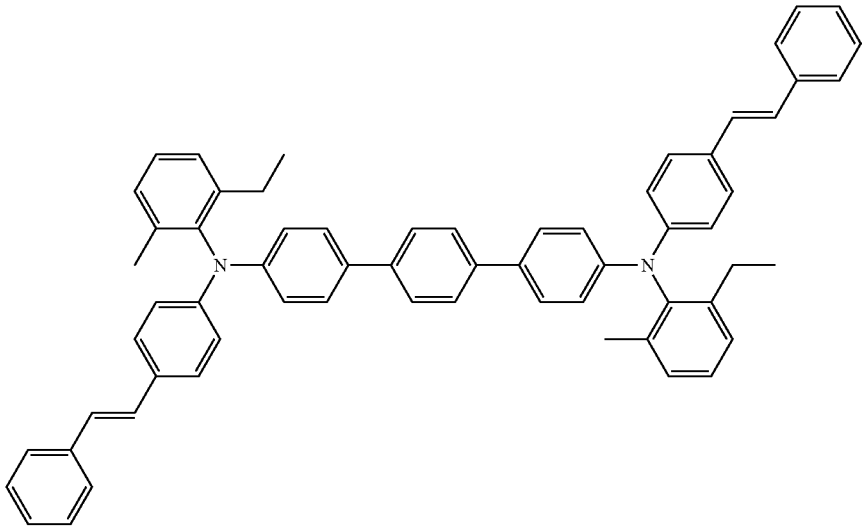

-continued
(1)-27
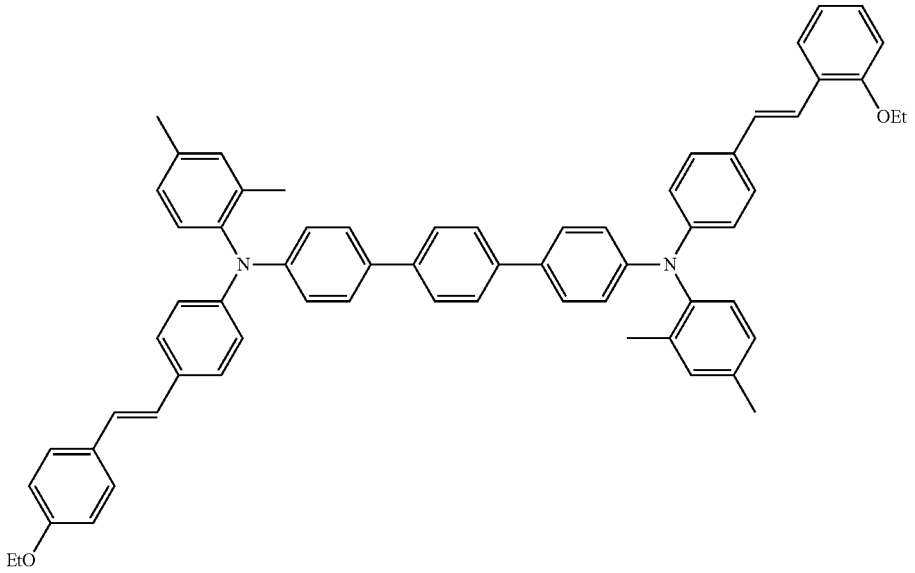
(1)-28
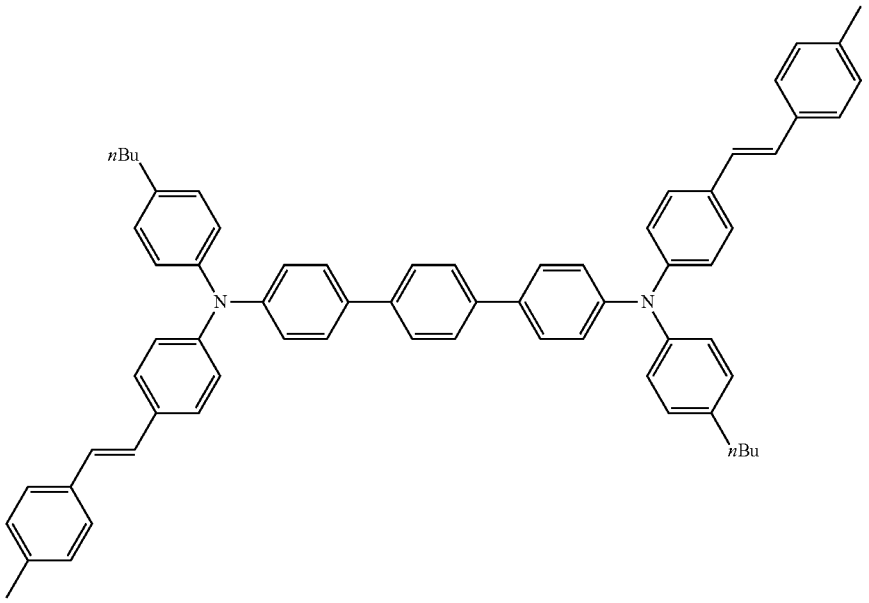

-continued
(1)-29
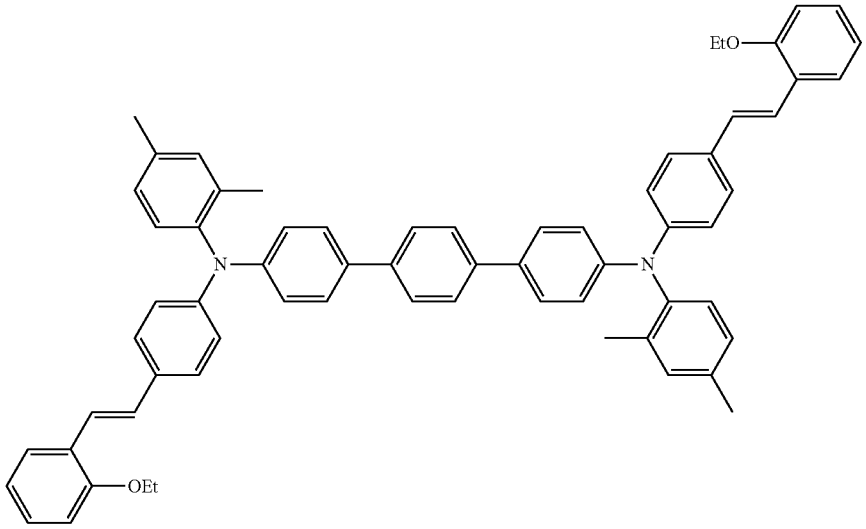
(2)-1
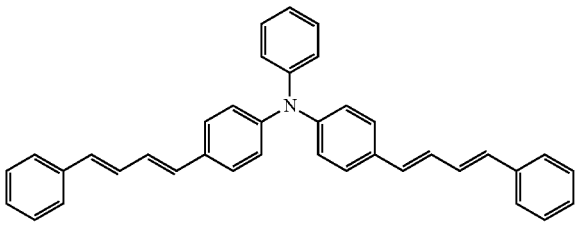
(2)-2
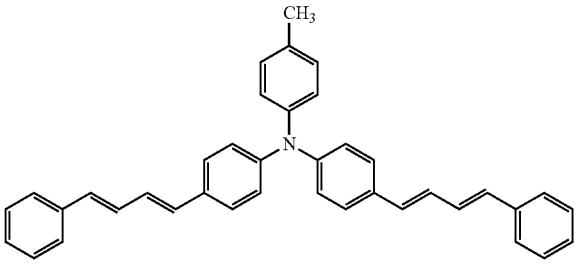
(2)-3
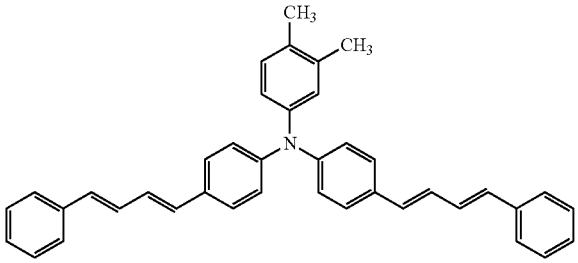
(2)-4
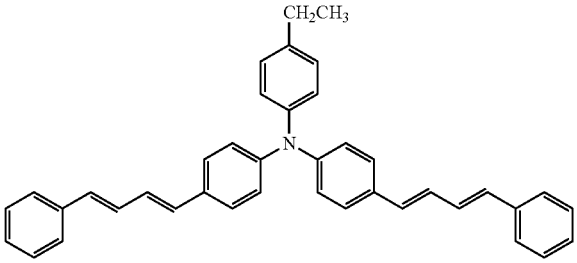
(2)-5
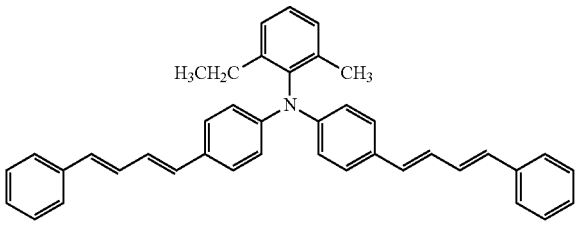
(2)-6
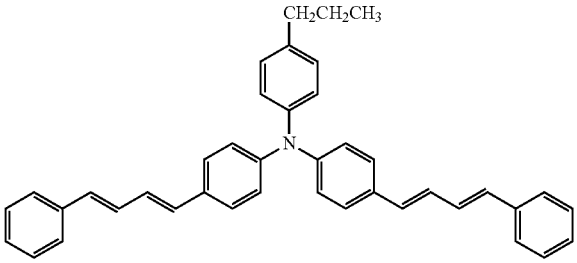

-continued
(2)-7
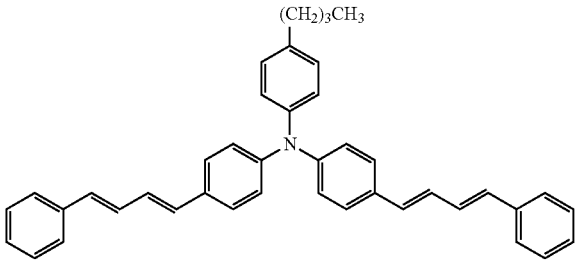
(2)-8
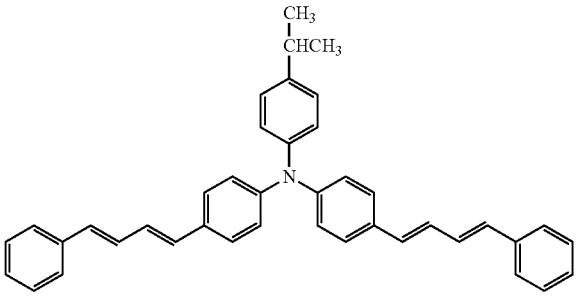
(2)-9
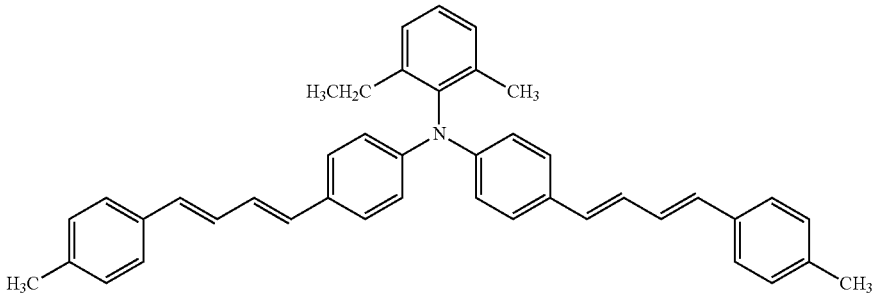
(2)-10
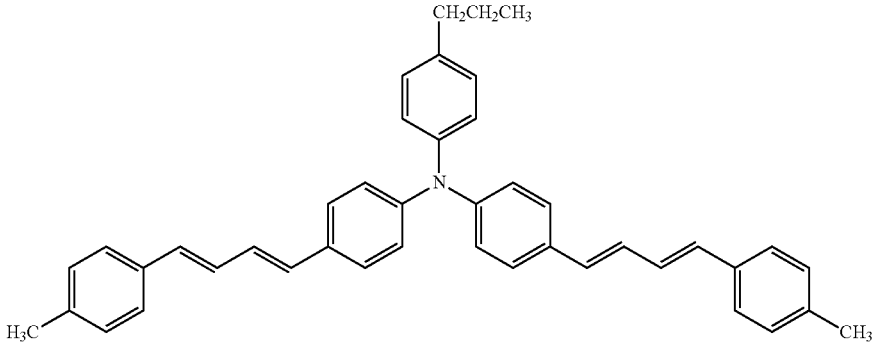
(2)-11
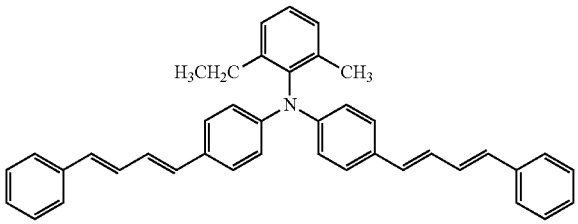
(2)-12
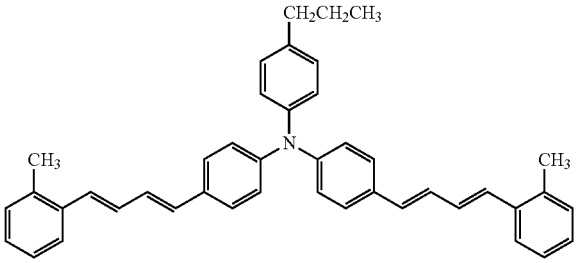
(2)-13
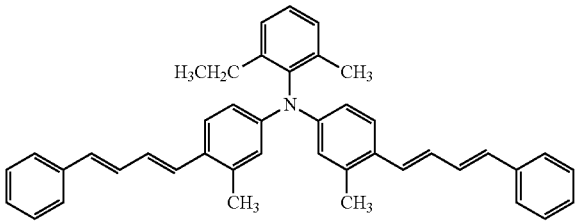
(2)-14
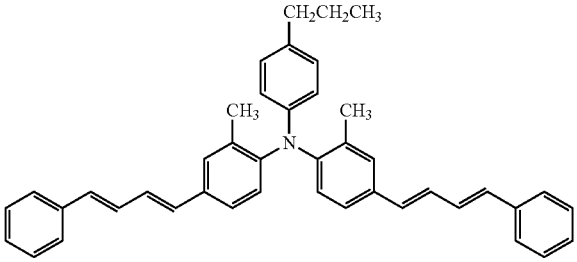

<Binder Resin>

In the photosensitive layer of the electrophotographic photoreceptor of the present invention, a copolymerized polycarbonate resin having, as the copolymerization component, repeating units represented by the following formulae (3) and (4) is contained as the binder resin in the same photosensitive layer as containing the charge transport material.

(3)

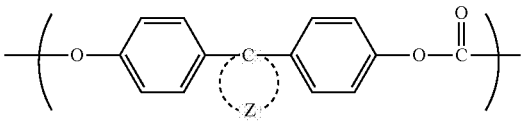

(In formula (3), Z forms a cyclic saturated aliphatic alkyl group having a carbon number of 5 to 8 including the carbon atom bonded thereto, and the cyclic saturated aliphatic alkyl group has from 1 to 3 methyl groups as the substituent).

(4)

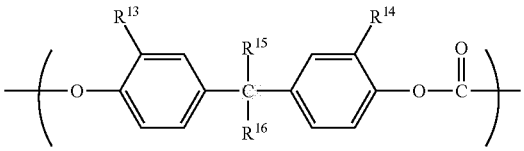

(In formula (4), each of $R^{13}$ to $R^{16}$ independently represents a hydrogen atom or a methyl group).

Preferred examples of formula (3) are shown below. By introducing a methyl group, the structural flexibility of cycloalkyl group is reduced, and the rigidity as a resin is increased. For example, Homopolymer (3)-6 shown below has Tg as high as 245° C., but Tg of the corresponding homopolymer with no methyl group substitution (common name: bisphenol-Z-polycarbonate) is 180° C. Also, asymmetrical introduction of methyl groups is advantageous in that the solubility is more increased and a trouble such as gelling of coating solution is inhibited.

(3)-1

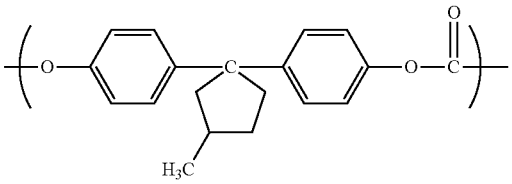

(3)-2

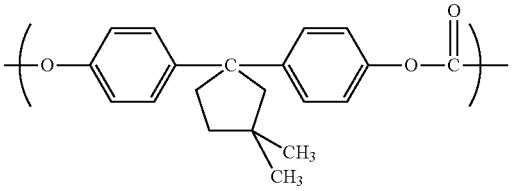

-continued (3)-3

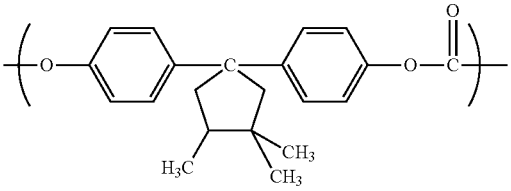

(3)-4

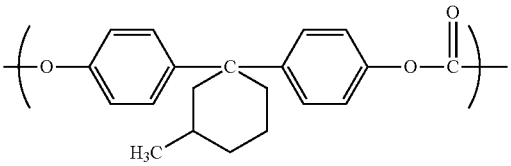

(3)-5

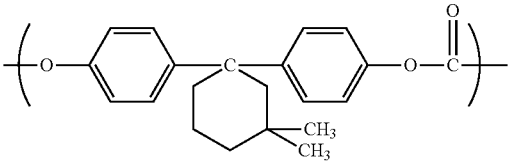

(3)-6

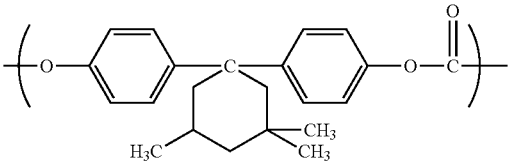

(3)-7

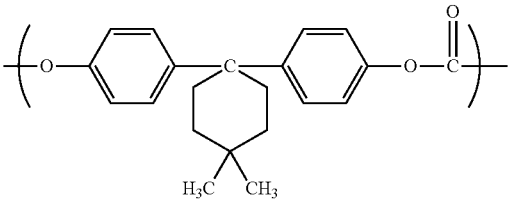

(3)-8

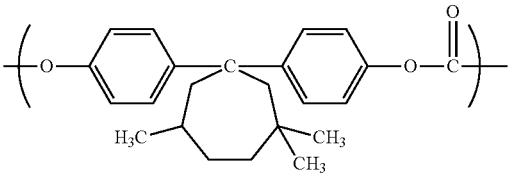

Among these, in view of mechanical properties and ease of resin production, (3)-5 and (3)-6 are preferred, and (3)-6 is most preferred. Incidentally, the resin of formula (3) is prevented by the methyl group substitution from undergoing a conformational transition of the cyclohexyl unit (transition between boat form and chair form) and in turn, Tg becomes high, but since the molecular structure is rigid, it is presumed that the free volume, that is, the gap between polymers, becomes larger than in a resin without methyl group substitution.

Preferred examples of formula (4) are shown below.

(4)-1

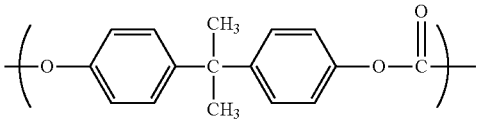

(4)-2

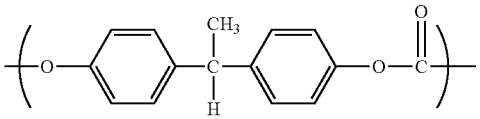

(4)-3

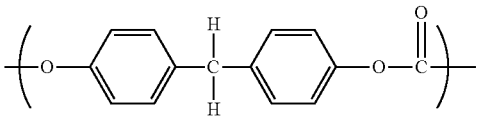

(4)-4

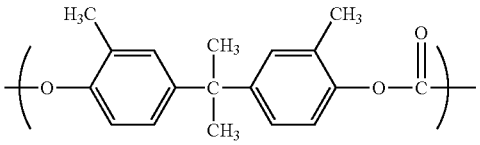

(4)-5

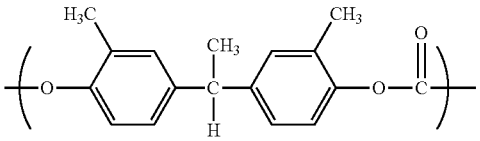

(4)-6

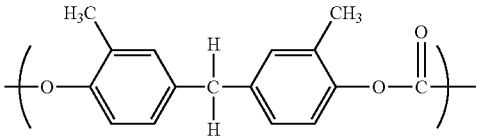

The homopolymer of formula (3) has very high Tg as described above and therefore, is not preferred in view of, for example, compatibility with the charge transport material or adhesion to substrate. On the other hand, the homopolymer of formula (4) has relatively low Tg, and for example, Tg of (4)-1 is about 150° C. Accordingly, by copolymerization of formula (3) with formula (4), Tg can be adjusted to an appropriate Tg. Among those, in view of mechanical properties, (4)-1 and (4)-4 are preferred, and (4)-1 is most preferred.

The copolymerization ratio between formula (3) and formula (4) is, in terms of (3):(4), preferably from 10:90 to 90:10, more preferably from 10:90 to 50:50, and most preferably from 15:85 to 40:60. The molecular weight is, in terms of weight average molecular weight (as polystyrene), preferably from 30,000 to 200,000, more preferably from 40,000 to 100,000.

The electrophotographic photoreceptor of the present invention including other constituent elements is described below.

The photoreceptor of the present invention comprises a photosensitive layer containing the specific charge transporting agent and the binder resin, which are described above. The photoreceptor of the present invention is usually provided on an electrically conductive support (sometimes referred to as "electrically conductive substrate").

[I. Electrophotographic Photoreceptor]

[I-1. Electrically Conductive Support]

The electrically conductive substrate which is predominantly used includes, for example, a metal material such as aluminum, aluminum alloy, stainless steel, copper and nickel, a resin material imparted with electrically conductivity by adding an electrically conductive powder such as tin oxide, and a resin, glass or paper having vapor-deposited or coated on the surface thereof an electrically conductive material such as aluminum, nickel and ITO (indium tin oxide alloy). As the form, a drum, a sheet, a belt and the like are used. Those obtained by coating a metal material-made electrically conductive support with an electrically conductive material having an appropriate resistance value so as to control the electrical conductivity, surface property or the like or cover a defect may be also used.

In the case where a metal material such as aluminum alloy is used as the electrically conductive support, the metal material may be used after an anodic oxide film is applied. When an anodic oxide film is applied, it is preferred to apply a sealing treatment by a known method.

The support surface may be smooth or may be roughened by using a special cutting method or applying an abrasive treatment. Also, the surface may be roughened by mixing particles having an appropriate particle diameter with the material constituting the support.

[I-2. Subbing Layer]

Between the electrically conductive support and the photosensitive layer, a subbing layer may be provided so as to improve adhesiveness, blocking property and the like.

As the subbing layer, for example, a resin or a resin having dispersed therein particles such as metal oxide particle is used. Examples of the metal oxide particle for use in the subbing layer include a metal oxide particle containing one metal element such as titanium oxide, aluminum oxide, silicon oxide, zirconium oxide, zinc oxide and iron oxide, and a metal oxide particle containing a plurality of metal elements such as calcium titanate, strontium titanate and barium titanate. Only one kind of a particle may be used, or a plurality of kinds of particles may be mixed and used. Among these metal oxide particles, titanium oxide and aluminum oxide are preferred, and titanium oxide is more preferred. The surface of the titanium oxide particle may be subjected to a treatment with an inorganic material such as tin oxide, aluminum oxide, antimony oxide, zirconium oxide and silicon oxide, or an organic material such as stearic acid, polyol and silicone. As for the crystal form of the titanium oxide particle, any of rutile, anatase, brookite and amorphous may be used. Also, a plurality of crystal forms may be contained.

Metal oxide particles having various particle diameters may be used, but above all, in view of characteristics and liquid stability, the particle diameter is, in terms of the average primary particle diameter, preferably from 10 to 100 nm, more preferably from 10 to 50 nm.

The subbing layer is preferably formed in a manner of metal oxide particles being dispersed in a binder resin. As the binder resin used in the subbing layer, phenoxy resin, epoxy resin, polyvinylpyrrolidone, polyvinyl alcohol, casein, polyacrylic acid, celluloses, gelatin, starch, polyurethane, polyimide or polyamide can be used alone or in a cured form together with a curing agent. Above all, for example, alcohol-soluble copolymerized polyamide and modified polyamide exhibit good dispersibility and coatability and are preferred. One binder resin for the subbing layer may be used alone, or two or more binder resins may be used in arbitrary combination at any ratio. Furthermore, other than using a binder resin alone, the binder resin may be also used in a cured form together with a curing agent.

In the case of a single-layer photoreceptor like the photoreceptor of the present invention, only with a single-layer photosensitive layer, adhesiveness to the support is bad and the photosensitive layer may be separated during use. On this account, a charge generation layer in a multilayer photoreceptor may be used to substitute for the subbing layer. In this case, for example, a layer formed by dispersing a phthalocyanine pigment or an azo pigment in a binder and coating the dispersion is suitably used as the subbing layer. At this time, in particular, excellent electrical characteristics may be advantageously obtained.

The mixing ratio of the inorganic particle to the binder resin may be arbitrarily selected, but in view of stability and coatability of the liquid dispersion, the inorganic particle is preferably used in a ratio of 10 to 500 mass %.

The film thickness of the subbing layer may be arbitrarily selected but in view of photoreceptor characteristics and coatability, is preferably from 0.1 to 20 μm. The subbing layer may contain a known antioxidant and the like.

[I-3. Photosensitive Layer]

The photosensitive layer is formed on the above-described electrically conductive support (in the case of providing the subbing layer, on the subbing layer). The photosensitive layer is a layer containing the charge transport material and the copolymerized polycarbonate resin, which are specified in the present invention. The type thereof includes a photosensitive layer of a single-layer structure in which a charge generating material and a charge transport material (including the charge transport material specified in the present invention) are present in the same layer and these materials are dispersed in a binder resin (including the copolymerized polycarbonate resin specified in the present invention) (hereinafter, sometimes referred to as "single-layer photosensitive layer"); and a functional separation-type photosensitive layer of a multilayer structure consisting of two or more layers including a charge generation layer in which a charge generating material is dispersed in a binder resin, and a charge transport layer in which a charge transport material (including the charge transport material specified in the present invention) is dispersed in a binder resin (including the copolymerized polycarbonate resin specified in the present invention) (hereinafter, sometimes referred to as "multilayer photosensitive layer"). The photosensitive layer may be of either type.

The multilayer photosensitive layer includes a forward lamination-type photosensitive layer in which a charge generation layer and a charge transport layer are stacked in this order from the electrically conductive support side, and a reverse lamination-type photosensitive layer in which conversely, a charge transport layer and a charge generation layer are stacked in this order from the electrically conductive support side. Either type can be employed, but a forward lamination-type photosensitive layer capable of exerting best balanced photoconductivity is preferred.

<Multilayer Photosensitive Layer>

<Charge Transport Layer>

In forming a charge transport layer of a functional separation-type photoreceptor having a charge generation layer and a charge transport layer, a binder resin is used so as to ensure film strength.

In the case of a charge transport layer of a functional separation-type photoreceptor, a coating solution obtained by dissolving or dispersing a charge transport substance and various binder resins in a solvent, or in the case of a single-layer photoreceptor, a coating solution obtained by dissolving or dispersing a charge generating substance, a charge transport substance and various binder resins in a solvent, is coated and dried, whereby the charge transport layer can be obtained.

<Binder Resin>

In the case where the electrophotographic photoreceptor of the present invention is a functional separation-type photoreceptor, a copolymerized polycarbonate resin having both of the above-described repeating units represented by formulae (3) and (4) as the copolymerization component is contained as the binder resin of the charge transport layer.

In addition to the copolymerized polycarbonate resin of the present invention, other resins may be mixed as the binder resin as long as the effects of the present invention are not impaired, and examples of other resins include a polymer or copolymer of a vinyl compound, such as butadiene resin, styrene resin, vinyl acetate resin, vinyl chloride resin, acrylic acid ester resin, methacrylic acid ester resin, vinyl alcohol resin and ethyl vinyl ether, and further include a polyvinylbutyral resin, a polyvinylformal resin, a partially modified polyvinylacetal, a polycarbonate resin, a polyester resin, a polyarylate resin, a polyamide resin, a polyurethane resin, a cellulose ester resin, a phenoxy resin, a silicon resin, a silicon-alkyd resin, and a poly-N-vinylcarbazole resin. Such a binder resin may be, before use, crosslinked under heat, light or the like by using an appropriate curing agent or may be modified with silicon or the like.

<Charge Transport Material>

The electrophotographic photoreceptor of the present invention contains, as the charge transport material, at least one charge transport material represented by formula (1) or (2). One charge transport substance represented by formula (1) or (2) may be used alone, or a plurality of charge transport substances may be used in combination at any ratio. Also, other known charge transport substances may be used in combination as long as the effects of the present invention are not impaired.

The amount used of charge transport material represented by formula (1) or (2) contained in the present invention is arbitrary as long as the effects of the present invention are not seriously impaired. However, if the amount used is too small, this is disadvantageous for charge transport and electrical characteristics are deteriorated. For this reason, the amount used is usually 20 parts by mass or more, preferably 30 parts by mass or more, per 100 parts by mass of the binder resin in the photosensitive layer. On the other hand, if the amount used is too large, the glass transition point (Tg) excessively decreases and the abrasion resistance is deteriorated. For this reason, the amount used is usually 150 parts by mass or less, preferably 100 parts by mass or less. Particularly, in the case where the molecular weight is low as in the copolymerized polycarbonate resin used in the present invention (in the case where the molecular weight is 60,000 or less in terms of weight average molecular weight, or 20,000 or less in terms of viscosity average molecular weight), scratch resistance and filming resistance tend to be poor and therefore, Tg need to be raised. On this account, the amount used of the charge transport material is preferably 70 parts by mass or less, more preferably 50 parts by mass or less.

<Charge Generation Layer>

The charge generation layer of a multilayer photosensitive layer (functional separation-type photosensitive layer) contains a charge generating material and usually further contains a binder resin and other components which are used, if desired. The charge generation layer can be obtained, for example, by dissolving or dispersing fine particles of charge generating material and a binder resin in a solvent or a dispersion medium to produce a coating solution, and coating and drying the produced coating solution on an electrically conductive support (when providing a subbing layer, on the subbing layer) in the case of a forward lamination-type photosensitive layer, or on a charge transport layer in the case of a reverse lamination-type photosensitive layer.

<Charge Generating Material>

Examples of the charge generating material which can be used include various photoconductive materials including selenium and its alloys, cadmium sulfide, other inorganic photoconductive materials, and organic pigments such as phthalocyanine pigment, azo pigment, dithioketopyrrolopyrrole pigment, squalene (squarylium) pigment, quinacridone pigment, indigo pigment, perylene pigment, polycyclic quinone pigment, anthanthrone pigment and benzimidazole pigment. In particular, an organic pigment is preferred, and a phthalocyanine pigment and an azo pigment are more preferred.

As the phthalocyanine used, specifically, various crystal forms of metal-free phthalocyanine or phthalocyanines having coordinated thereto a metal such as copper, indium, gallium, tin, titanium, zinc, vanadium, silicon and germanium, or its oxide, halide, hydroxide or alkoxide, may be used. In particular, X-type or τ-type metal-free phthalocyanine as a highly sensitive crystal form; titanyl phthalocyanine (another name: oxytitanium phthalocyanine) such as A-type (another name: β-type), B-type (another name: α-type) and D-type (another name: Y-type); vanadyl phthalocyanine; chloroindium phthalocyanine; chlorogallium phthalocyanine such as II-type; hydroxygallium phthalocyanine such as V-type; μ-oxo-gallium phthalocyanine dimer such as G-type and I-type; and μ-oxo-aluminum phthalocyanine dimer such as II-type, are suitable. Among these phthalocyanines, a metal-containing phthalocyanine containing a metal in the center of the phthalocyanine ring is preferred. Among metal-containing phthalocyanines, A-type (β-type), B-type (α-type) or D-type (Y-type) oxytitanium phthalocyanine, II-type chlorogallium phthalocyanine, V-type hydroxygallium phthalocyanine, and G-type μ-oxo-gallium phthalocyanine dimer are preferred, and A-type (β-type), B-type (α-type) or D-type (Y-type) oxytitanium phthalocyanine is more preferred.

Above all, the oxytitanium phthalocyanine is preferably an oxytitanium phthalocyanine having a main distinct diffraction peak at a Bragg angle)(2θ±0.2° of 27.2° in the powder X-ray diffraction spectrum by CuKα characteristic X-ray. Also, the oxytitanium phthalocyanine preferably has a distinct diffraction peak at a Bragg angle (2θ±0.2°) of 9.0° to 9.7° in the powder X-ray diffraction spectrum by CuKα characteristic X-ray.

In the case of using an azo pigment as the charge generating material, various known bisazo pigments and trisazo pigments are suitably used.

With respect to the pigment used as the charge generating material, a preferred material is sometimes determined by the exposure wavelength used. In the case where the exposure wavelength is in a short-wavelength region of approximately from 380 to 500 nm, the above-described azo pigment is suitably use. On the other hand, in the case of using near infrared light at approximately from 630 to 780 nm, the phthalocyanine pigment having high sensitivity also in that region and some azo pigments are suitably used. Also in the case where environmental characteristics, for example, low dependency on humidity, are demanded, since the oxytitanium phthalocyanine having a distinct diffraction peak at a Bragg angle (2θ±0.2°) of 9.0° to 9.7° in the powder X-ray diffraction spectrum by CuKα characteristic X-ray has large dependency on humidity, the above-described azo pigment is suitably used.

The particle diameter of the charge generating material used is preferably small enough. Specifically, the particle diameter is usually 1 μm or less, preferably 0.5 μm or less.

Furthermore, if the amount of the charge generating material dispersed in the photosensitive layer is too small, sufficient sensitivity may not be obtained, whereas if the amount is too large, this has adverse effects such as decrease in chargeability, decrease in sensitivity and reduction in smoothness due to aggregation. For this reason, the amount of the charge generating material in the charge generation layer of the multilayer photosensitive layer is usually 20 mass % or more, preferably 40 mass % or more, and is usually 90 mass % or less, preferably 70 mass % or less.

<Binder Resin>

The binder resin used in the charge generation layer constituting the multilayer photosensitive layer is not particularly limited, but examples thereof include a polyvinylbutyral resin, a polyvinylformal resin, a polyvinylacetal-based resin such as partially acetalized polyvinylbutyral resin in which butyral is partially modified with formal, acetal or the like, a polyarylate resin, a polycarbonate resin, a polyester resin, a modified ether-based polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinylpyridine resin, a cellulose-based resin, a polyurethane resin, an epoxy resin, a silicone resin, a polyvinyl alcohol resin, a polyvinylpyrrolidone resin, casein, a vinyl chloride-vinyl acetate-type copolymer such as vinyl chloride-vinyl acetate copolymer, hydroxy-modified vinyl chloride-vinyl acetate copolymer, carboxyl-modified vinyl chloride-vinyl acetate copolymer and vinyl chloride-vinyl acetate-maleic anhydride copolymer, a styrene-butadiene copolymer, a vinylidene chloride-acrylonitrile copolymer, a styrene-alkyd resin, a silicon-alkyd resin, an insulating resin such as phenol-formaldehyde resin, and an organic photoconductive polymer such as poly-N-vinylcarbazole, polyvinylanthracene and polyvinylperylene. Any one of these binder resins may be used alone, or two or more kinds thereof may be used as a mixture in arbitrary combination.

The charge generation layer is specifically formed by dissolving the above-described binder resin in an organic solvent, dispersing a charge generating substance in the resultant solution to prepare a coating solution, and applying the coating solution on an electrically conductive support (in the case of providing a subbing layer, on the subbing layer).

<Single-Layer Photosensitive Layer>

Similarly to the charge transport layer of a functional separation-type photoreceptor, the single-layer photosensitive layer is formed using a charge generating substance and at least one charge transport substance represented by formula (1) or (2) and additionally using, as the binder resin, a copolymerized polycarbonate resin having both repeating units represented by formulae (3) and (4) as the copolymerization component. Specifically, a charge generating substance, a charge transport substance and various binder resins are dissolved or dispersed in a solvent to produce a coating solution, and the coating solution is coated and dried on an electrically conductive support (in the case of providing a subbing layer, on the subbing layer), whereby a photosensitive layer of this type can be obtained.

The kinds of the charge transport substance and binder resin and the proportions of these used are the same as those described for the charge transport layer of a multilayer photoreceptor. A charge generating substance is further dispersed in a charge transport medium composed of the charge transport substance and the binder resin.

As the charge generating substance, the same as those described above for the charge generation layer of a multilayer type photoreceptor can be used. However, in the case of the photosensitive layer of the single-layer photoreceptor, it is necessary that the particle diameter of the charge generating substance is sufficiently small. Specifically, the particle diameter is usually 1 μm or less, preferably 0.5 μm or less.

If the amount of the charge generating substance dispersed in the single-layer photosensitive layer is too small, sufficient sensitivity may not be obtained, whereas if the amount is too large, this has adverse effects such as reduction in chargeability and decrease in sensitivity. For this reason, the charge generating substance is used in an amount of usually 0.5 mass % or more, preferably 1 mass % or more, and is usually 50 mass % or less, preferably 20 mass % or less, based on the entire single-layer photosensitive layer.

As for the proportions of the binder resin and the charge generating substance used in the single-layer photosensitive layer, the amount of the charge generating substance is usually 0.1 parts by mass or more, preferably 1 part by mass or more, and is usually 30 parts by mass or less, preferably 10 parts by mass or less, per 100 parts by mass of the binder resin.

In both the multilayer photoreceptor and the single-layer photoreceptor, the photosensitive layer or each layer constituting the photosensitive layer may contain known components such as antioxidant, plasticizer, ultraviolet absorber, electron-withdrawing compound, leveling agent and visible light-shielding agent, for the purpose of improving film deposition property, flexibility, coatability, contamination resistance, gas resistance, light resistance and the like.

Other constituent components of the photosensitive layer are described below.

<Other Constituent Components>

The photosensitive layer may further contain various additives. These additives are used for improving film deposition property, flexibility, mechanical strength and like, and examples thereof include a plasticizer, a light absorber for short-wavelength light such as ultraviolet rays, an antioxidant, a residual potential control agent for controlling residual potential, a dispersion aid for enhancing dispersion stability, a leveling agent for improving coatability (such as silicone oil and fluorine-containing oil), and a surfactant. One additive may be used, or two or more additives may be used in arbitrary combination at any ratio.

<Film Thickness>

In the photoreceptor of the present invention, the film thickness of the photosensitive layer is not limited and is arbitrary as long as the effects of the present invention are not seriously impaired, but in the case of a single-layer photoreceptor, the film thickness is usually 10 μm or more, preferably 15 μm or more, and is usually 50 μm or less, preferably 45 μm or less. In the case of a multilayer photoreceptor, the film thickness of the charge generation layer is preferably from 0.1 to 1 μm, more preferably from 0.2 to 0.8 μm, and the film thickness of the charge transport layer is usually 5 μm or more, preferably 10 μm or more, and is usually 40 μm or less, preferably 35 μm or less. The charge transport layer may be composed not only of a single layer but also of two or more different layers.

[I-4. Other Layers]

A protective layer may be provided as an outermost surface layer on the photosensitive layer. Examples of the protective layer include a thin film having dispersed therein a resin particle such as fluororesin, silicone resin and crosslinked polystyrene resin, or an inorganic particle such as alumina particle and silica particle, and a thin film formed by polymerizing a monomer unit containing a charge transport component. The thickness of the protective layer is preferably 10 μm or less, more preferably 7 μm or less.

[I-5. Method for Forming Each Layer]

The method for forming each layer such as subbing layer, photosensitive layer and protective layer is not limited. For example, there may be applied a known method where the materials contained in the layer to be formed are dissolved or dispersed in a solvent to obtain a coating solution and the obtained coating solutions are successively coated on an electrically conductive support directly or through another layer. After the coating, the solvent is removed by drying, whereby the photosensitive layer is formed.

At this time, the coating method is not limited and is arbitrary and, for example, a dip coating method, a spray coating method, a nozzle coating method, a bar coating method, a roll coating method, and a blade coating method may be used. Among these, a dip coating method is preferred in view of high productivity. Incidentally, out of these coating methods, only one method may be performed, or two or more methods may be performed in combination.

[I-6. Electrification Type of Photoreceptor]

The photoreceptor of the present invention is used for the later-described to form an image. The multilayer photoreceptor of the present invention is used by being negatively charged, and the single-layer photoreceptor is used by being positively charged.

[I-7. Exposure Wavelength for Photoreceptor]

At the image formation, the photoreceptor of the present invention is exposed to writing light from an exposure device, whereby an electrostatic latent image is formed. The writing light used here is arbitrary as long as an electrostatic latent image can be formed, but among others, monochromatic light having an exposure wavelength of usually 380 nm or more, particularly 400 nm or more, and of usually 850 nm or less, is used. In particular, when monochromatic light at 480 nm or less is used, the photoreceptor can be exposed to light having a smaller spot size and a high-quality image having high resolution and high gradation can be formed. For this reason, in the case of wishing to obtain a high-quality image, the photoreceptor is preferably exposed to monochromatic light at 480 nm or less.

[II. Image-forming Apparatus]

An embodiment of the image-forming apparatus (image-forming apparatus of the present invention) using the electrophotographic photoreceptor of the present invention is described below by reference to FIG. 1 illustrating the configuration of main parts of the apparatus. However, the embodiment is limited to the following description, and the present invention can be performed by arbitrarily making modifications therein without departing from the purport of the present invention.

As shown in FIG. 1, the image-forming apparatus is configured to comprise an electrophotographic photoreceptor 1, a charging device (charging portion) 2, an exposure device (exposure portion; imagewise exposure portion) 3, and a developing device (developing portion) 4. Furthermore, a transfer device (transfer portion) 5, a cleaning unit (cleaning portion) 6, and a fixing device (fixing portion) 7 are provided, if desired.

The electrophotographic photoreceptor 1 is not particularly limited as long as it is the above-described electrophotographic photoreceptor of the present invention, but FIG. 1 shows, as an example thereof, a drum-shaped photoreceptor in which the photosensitive layer described above is formed on the surface of a cylindrical electrically conductive support. Along the outer peripheral surface of the electrophotographic photoreceptor 1, the charging device 2, the exposure device 3, the developing device 4, the transfer device 5, and the cleaning unit 6 are disposed.

The charging device 2 serves to positively charge the electrophotographic photoreceptor 1 and evenly charges the surface of the electrophotographic photoreceptor 1 to a given potential. FIG. 1 shows a roller-type charging device (charging roller) as an example of the charging device 2, but in addition, a corona charging device such as corotron and scorotron, a contact-type charging device such as charging brush, or the like is often used.

In many cases, the electrophotographic photoreceptor 1, the charging device 2 and the cleaning unit 6 are designed as a cartridge (the electrophotographic photoreceptor cartridge of the present invention; hereinafter, sometimes referred to as "photoreceptor cartridge") capable of being removed from the main body of the image-forming apparatus and replaced. For example, when the electrophotographic photoreceptor 1, the charging device 2, or the cleaning unit 6 is deteriorated, this photoreceptor cartridge can be removed from the main body of the image-forming apparatus and a fresh photoreceptor cartridge can be mounted in the main body of the image-forming apparatus. The later-described toner is also in many cases designed to be stored in a toner cartridge and be removable from the main body of the image-forming apparatus, and when the toner in the toner cartridge in use runs out, the toner cartridge can be removed from the main body of the image-forming apparatus and a fresh toner cartridge can be mounted. Furthermore, there is a case of using a cartridge including all of an electrophotographic photoreceptor 1, a charging device 2, a cleaning unit 6, and a toner.

The exposure device 3 is not particularly limited in its kind as long as it can expose (imagewise expose) the electrophotographic photoreceptor 1 to light and thereby form an electrostatic latent image in the photosensitive surface of the electrophotographic photoreceptor 1. Examples thereof include a halogen lamp, a fluorescent lamp, a laser such as semiconductor laser and He—Ne laser, and LED (light-emitting diode). Exposure may be also performed by an internal photoreceptor exposure system. Although light used when performing the exposure is arbitrary, monochromatic light is generally preferred and, for example, the exposure may be performed to monochromatic light at a wavelength (exposure wavelength) of 700 to 850 nm, monochromatic light at a slightly shorter wavelength of 600 to 700 nm, or monochromatic light at a short wavelength of 300 to 500 nm.

The developing device 4 is not particularly limited in its kind as long as it can develop the electrostatic latent image on the exposed electrophotographic photoreceptor 1 to form a visible image. Specifically, for example, an arbitrary device including a device by dry development such as cascade development, one-component electrically conductive toner development and two-component magnetic brush development, and a wet development, may be used. In FIG. 1, the developing device 4 is composed of a development tank 41, an agitator 42, a feed roller 43, a developing roller 44 and a regulating member 45 and is configured to store a toner T in the inside of the development bath 41. If desired, a replenishing device (not shown) for replenishing the toner T may be further attached to the developing device 4. This replenishing device is configured such that the toner T can be replenished from a container such as bottle and cartridge.

The feed roller 43 is composed of an electrically conductive sponge or the like. The developing roller 44 is composed of, for example, a metal roll such as iron, stainless steel, aluminum and nickel, or a resin roll obtained by coating such a metal roll with a silicone resin, a urethane resin, a fluororesin or the like. The surface of the developing roller 44 may be subjected to smoothing processing or roughening processing, if desired.

The developing roller 44 is disposed between the electrophotographic photoreceptor 1 and the feed roller 43 and is in contact with each of the electrophotographic photoreceptor 1 and the feed roller 43. However, the developing roller 44 and the electrophotographic photoreceptor 1 may not be contacted but be close to each other. The feed roller 43 and the developing roller 44 are rotated by a rotation driving mechanism (not shown). The feed roller 43 carries the toner T stored and supplies it to the developing roller 44. The developing roller 44 carries the toner T supplied by the feed roller 43 and brings it into contact with the surface of the electrophotographic photoreceptor 1.

The regulating member 45 is formed as a resin blade made of silicone resin, urethane resin or the like, a metal blade made of stainless steel, aluminum, copper, brass, phosphor bronze or the like, or a blade obtained by coating such a metal blade with a resin or the like. The regulating member 45 is usually in contact with the developing roller 44 and is pressed onto the developing roller 44 by means of a spring or the like under a given force (the linear blade pressure is generally from 0.05 to 5 N/cm). If desired, the regulating member 45 may be imparted with a function of charging the toner T by triboelectric charging with the toner T.

The agitator 42 is provided, if desired, and rotated by a rotation driving mechanism to agitate the toner T and at the same time, convey the toner T to the feed roller 43 side. A plurality of agitators 42 differing in blade shape, size or the like may be provided.

The transfer device 5 is not particularly limited in its kind, and a device by an arbitrary system such as electrostatic transfer method (e.g., corona transfer, roller transfer, belt transfer), pressure transfer method and adhesive transfer method, may be used. Here, the transfer device 5 is composed of a transfer charger, a transfer roller, a transfer belt or the like disposed to face the electrophotographic photoreceptor 1. The transfer device 5 is applied with a given voltage (transfer voltage) having polarity opposite to the charge potential of the toner T and transfers the toner image formed on the electrophotographic photoreceptor 1 to recording paper (paper, medium, or receiving object) P.

The cleaning unit 6 serves to scrape off the residual toner adhering to the photoreceptor 1 with a cleaning blade and hold the toner in a recovery vessel so as to recover the residual toner. The cleaning blade is composed of an elastic rubber member and a supporting member, and if desired, an edge member may be further provided on the elastic rubber member in the portion contacted with the photoreceptor. For the cleaning blade member, polyurethane is generally used, because polyurethane has good abrasion resistance, despite an elastic body, exhibits sufficient mechanical strength even without addition of a reinforcement or the like, and is non-contaminating. However, physical properties of polyurethane are known to be temperature-dependent. Temperature dependency develops particularly in the impact resilience, and this is a problem for cleaning. That is, when the impact resilience is decreased at low temperature, a cleaning failure occurs, whereas when the impact resilience is increased at high temperature, there arise a problem of edge chipping or chattering. Therefore, it is demanded to offer a highly functional cleaning blade or the like ensuring sufficiently stable impact resilience even upon occurrence of an environmental change. In particular, with the recent trend toward size reduction of appliances, the temperature inside an appliance is liable to rise, and there is a growing demand for decrease in the temperature dependency of impact resilience. From the standpoint of enhancing the cleaning efficiency, the elastic rubber member or edge member is preferably formed of a polyurethane using, as the raw material, a polyester polyol obtained by a reaction of adipic acid with a diol component or using a caprolactone-based polyester polyol to make a polyurethane having such impact resilience. The property of the polyurethanes is preferably such that the 100% permanent elongation is 3% or less, the impact resilience at 25° C. is 20% or less, and the difference between the maximum and minimum values of impact resilience between 10° C. and 50° C. is 30% or less.

Also, from the standpoint of improving the cleaning property, the cleaning blade is preferably in counter contact with the photoreceptor.

The fixing device 7 is composed of an upper fixing member (fixing roller) 71 and a lower fixing member (fixing roller) 72, and a heating device 73 is provided inside the fixing member 71 or 72. Incidentally, FIG. 1 shows an example where a heating device 73 is provided inside the upper fixing member 71. For each of the upper and lower fixing members 71 and 72, a known heat-fixing member such as fixing roll obtained by coating a metal blank tube made of stainless steel, aluminum or the like with silicone rubber, fixing roll further coated with a Teflon (registered trademark) resin, and fixing sheet, may be used. Furthermore, the fixing members 71 and 72 each may be configured to be supplied with a release agent such as silicone oil so as to improve release properties or may be configured to be forcedly pressed against each other by means of a spring or the like.

The toner transferred on the recording paper P passes between the upper fixing member 71 heated to a given temperature and the lower fixing member 72, during which the toner is heated to a molten state, and after the passing, the toner is cooled and fixed to the recording paper P.

The fixing device is also not particularly limited in its kind, and not only the device used here but also a fixing device by an arbitrary system such as heated-roller fixing, flash fixing, oven fixing and pressure fixing, may be provided.

In the electrophotographic apparatus having such a configuration, an image is recorded through a charging step of charging the photoreceptor, an exposure step of exposing the charged electrophotographic photoreceptor to light to form an electrostatic latent image, a development step of developing the electrostatic latent image with a toner, and a transfer step of transferring the toner to a receiving object are performed. That is, the surface (photosensitive surface) of the photoreceptor 1 is first charged to a given potential by the charging device 2 (charging step). At this time, the photoreceptor may be charged by using a direct-current voltage or by superposing an alternating-current voltage on a direct-current voltage.

Subsequently, the photoreceptor is exposed to light to form an electrostatic latent image (exposure step). That is, the photosensitive surface of the charged photoreceptor 1 is exposed by the exposure device 3 according to the image to be recorded to form an electrostatic latent image in the photosensitive surface.

The electrostatic latent image formed in the photosensitive surface of the photoreceptor 1 is developed by the developing device 4 (development step). In the developing device 4, the toner T supplied by the feed roller 43 is formed into a thin layer with the regulating member (developing blade) 45 and at the same time, triboelectrically charged to have a given polarity (here, the polarity is the same as the charge potential of the photoreceptor 1 and is a positive polarity), and the toner is conveyed while being carried by the developing roller 44 and is brought into contact with the surface of the photoreceptor 1. When the charged toner T carried on the developing roller 44 comes into contact with the surface of the photoreceptor 1, a toner image corresponding to the electrostatic latent image is formed on the photosensitive surface of the photoreceptor 1.

This toner image is then transferred onto recording paper P by the transfer device 5 (transfer step). Thereafter, the toner remaining on the photosensitive surface of the photoreceptor 1 without being transferred is removed by the cleaning unit 6.

After the transfer of the toner image onto the recording paper P, the recording paper P is passed through the fixing device 7 to thermally fix the toner image on the recording paper, and a finished image is thereby obtained.

Incidentally, the image-forming apparatus may be configured to perform, for example, an erase step, in addition to the configuration described above. The erase step is a step of exposing the electrophotographic photoreceptor to light and thereby erasing the residual charges from the electrophotographic photoreceptor. As the eraser, a fluorescent lamp, LED or the like is used. Also, the light used in the erase step is, in many cases, light having such an intensity that the exposure energy is 3 times or more the energy of the exposure light.

The configuration of the image-forming apparatus may be further modified. For example, there may be employed a configuration where a step such as pre-exposure step and auxiliary charging step can be performed, a configuration where offset printing is performed, or a full-color tandem configuration using a plurality of toners.

EXAMPLES

The embodiment of the present invention is described in greater detail below by referring to Examples. However, the following Examples are given for explaining the invention in detail, and the invention is not limited to these Examples but can be performed by arbitrarily making modifications therein without departing from the purport of the present invention. In the following Production Examples, Examples and Comparative Examples, unless otherwise indicated, the "parts" indicates "parts by mass". Incidentally, the polycarbonate resins used in Examples and Comparative Examples are resins commercially available under the trade name of APEC from Bayer AG and were used in the purchased state without further purification.

Example 1

<Production of Coating Solution for Subbing Layer Formation>

Rutile titanium oxide having an average primary particle diameter of 40 nm ("TTO55N", produced by Ishihara Sangyo Kaisha, Ltd.) and methyldimethoxysilane ("TSL8117", produced by Toshiba Silicones) in an amount of 3 mass % based on the titanium oxide were mixed in a Henschel mixer, and the obtained surface-treated titanium oxide was dispersed in a mixed solvent of methanol/1-propanol at a mass ratio of 7/3 by a ball mill to make a slurry dispersion of surface-treated titanium oxide. The slurry dispersion, a mixed solvent of methanol/1-propanol/toluene, and a pellet of a copolymerized polyamide composed of ϵ-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] in a compositional molar ratio of 60%/15%/5%/15%/5% were stirred and mixed under heating to dissolve the polyamide pellet, and thereafter, an ultrasonic dispersion treatment was performed to produce a coating solution for subbing layer formation, containing surface-treated titanium oxide/copolymerized polyamide in a mass ratio of 3/1 and having a solid content concentration of 18.0%, in which the mass ratio of methanol/1-propanol/toluene was 7/1/2.

A

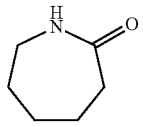

B

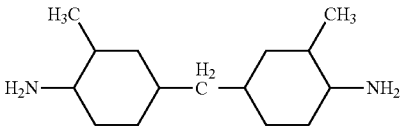

C

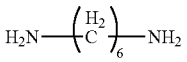

D

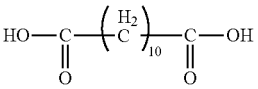

E

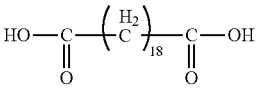

<Production of Coating Solution for Charge Generation Layer Formation>

20 Parts of Y-form oxytitanium phthalocyanine exhibiting a strong diffraction peak at a Bragg angle (2θ±0.2°) of 27.3° in X-ray diffraction by CuKα ray was mixed as a charge generating substance with 280 parts of 1,2-dimethoxyethane, and the mixture was subjected to a pulverization/dispersion treatment by grinding in a sand grinding mill for 1 hour. Subsequently, the liquid resulting from this pulverization treatment was mixed with 230 parts of 1,2-dimethoxyethane and a binder solution obtained by dissolving 10 parts of polyvinylbutyral ("Denim Butyral" #6000C, trade name, produced by Denki Kagaku Kogyo K.K.) in a mixed solution of 255 parts of 1,2-dimethoxyethane and 85 parts of 4-methoxy-4-methyl-2-pentanone, to prepare a coating solution for charge generation layer formation.

<Production of Coating Solution for Charge Transport Layer Formation>

100 Parts of polycarbonate resin (PC-1) having the following repeating structure (m:n=60:40, weight average molecular weight (Mw)=47,000, number average molecular weight (Mn)=19,000), 30 parts of Compound (1)-7 as a charge transport material, 8 parts by mass of IRGANOX 1076, trade name, produced by Ciba Specialty Chemicals Co., as an antioxidant, and 0.05 parts of silicone oil (KF96, trade name, produced by Shin-Etsu Silicone) as a leveling agent were dissolved in 520 parts of a THF/toluene (8/2 (by mass)) mixed solvent to prepare a coating solution for charge transport layer formation.

<Production of Photoreceptor Sheet>

Using an electrically conductive support obtained by forming an aluminum deposition film (thickness: 70 nm) on the surface of a biaxially stretched polyethylene terephthalate resin film (thickness: 75 μm), the coating solution for subbing layer formation, the coating solution for charge generation layer formation, and the coating solution for charge transport layer formation were successively coated on the deposition layer of the support by a bar coater and dried to form a subbing layer, a charge generation layer and a charge transport layer having a dry thickness of 1.3 μm, 0.4 μm and 25 μm, respectively, whereby a photoreceptor sheet was obtained. Incidentally, the drying of the charge transport layer was performed at 125° C. for 20 minutes.

<Electrical Characteristic Test>

Using an apparatus for evaluating electrophotographic characteristics manufactured in accordance with the measurement standards of the Society of Electrophotography of Japan (described in *Zoku Denshi Shashin Gijutsu no Kiso to Oyo* (*Basic and Application of Electrophotographic Technology, Part II*), compiled by the Society of Electrophotography of Japan, Corona Publishing Co., Ltd., pp. 404-405), the photoreceptor sheet obtained above was laminated on an aluminum-made tube having a diameter of 80 mm and after attaching a grounding wire, charged to give an initial surface potential of −700 V while rotating it at 100 rpm. Monochromatic light of 780 nm produced by passing light from a halogen lamp through an interference filter was used together with ND filters differing in the transmittance to examine the surface potential attenuation behavior by changing the quantity of light. At this time, after exposure at each quantity of light, the photoreceptor was once exposed to 660-nm LED light as erase light to cancel most of residual charges. As the measured value, the exposure amount necessary for halving the surface potential (half-decay exposure amount; referred to as $E_{1/2}$) and the surface potential when exposed to 780-nm monochromatic light in an amount of 0.56 μJ/cm$^2$ (initial bright potential; referred to as VL) were determined. Also, the above-described process of charging/exposure (0.56 μJ/cm$^2$ exposure)/erasing was repeated 30,000 times, and the variation of VL ([VL value after repetition]−[VL value before repetition]; referred to as ΔVL) was determined. The results are shown in Table 1. Δs the absolute value of ΔVL is smaller, the surface potential is more stable.

<Image Memory Test>

In the electric characteristic test above, a step of loading a positive voltage of +6.5 kV by a corotron charger instead of erase light, as a simulation of the transfer process, was provided. This process of charging/exposure/positive voltage loading was repeated 4,000 times, and the variation ([dark potential value after repetition]−[dark potential value before repetition]; referred to as ΔVO) of the surface potential (dark potential) was determined. The results are shown in Table 1.

PC-1

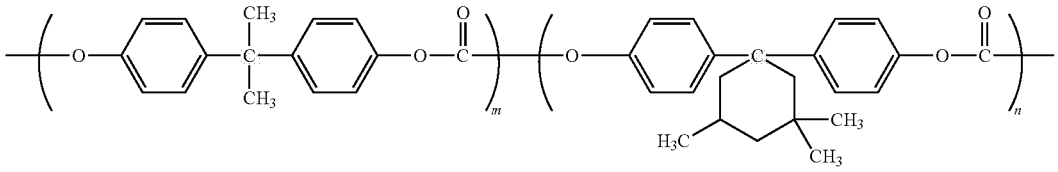

(m:n = 60:40)

As the absolute value of ΔVO is smaller, an image memory attributable to the transfer process is less likely to be caused.

<Tabor Abrasion Test>

The photoreceptor sheet was cut into a circular form of 10 cm in diameter and evaluated for abrasion by a Taber abrasion tester (manufactured by Toyo Seiki Seisaku-Sho, Ltd.). The test was performed under the conditions of an atmosphere of 23° C. and 50% RH, use of an abrasion wheel CS-10F, a load of 500 g and 1,000 rotations, and the abrasion amount was measured from the mass loss after the test. The results are shown in Table 1. A smaller abrasion amount indicates better abrasion resistance.

Example 2

A photoreceptor was produced and evaluated in the same manner as in Example 1 except for changing the amount of the charge transport material to 40 parts. The results are shown in Table 1.

Example 3

A photoreceptor was produced and evaluated in the same manner as in Example 1 except for changing the amount of the charge transport material to 50 parts. The results are shown in Table 1.

Example 7

A photoreceptor was produced and evaluated in the same manner as in Example 1 except for changing the charge transport material to (2)-7. The results are shown in Table 1.

Example 8

A photoreceptor was produced and evaluated in the same manner as in Example 7 except for changing the amount of the charge transport material to 40 parts. The results are shown in Table 1.

Example 9

A photoreceptor was produced and evaluated in the same manner as in Example 7 except for changing the amount of the charge transport material to 50 parts. The results are shown in Table 1.

Example 10

A photoreceptor was produced and evaluated in the same manner as in Example 1 except for using, as the binder resin, Resin (PC-2) in which m:n=67:33, the weight average molecular weight (Mw)=55,000 and the number average molecular weight (Mn)=22,000, in place of PC-1. The results are shown in Table 1.

PC-2

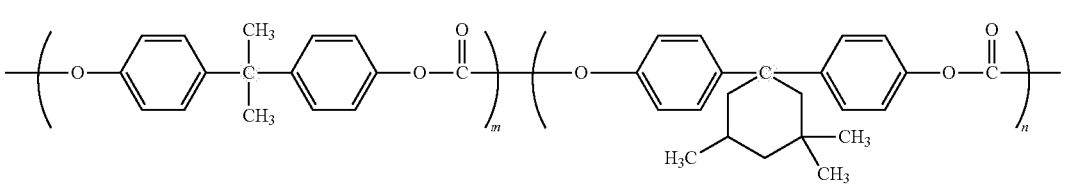

(m:n = 67:33)

Example 4

A photoreceptor was produced and evaluated in the same manner as in Example 1 except for changing the charge transport material to (1)-10. The results are shown in Table 1.

Example 5

A photoreceptor was produced and evaluated in the same manner as in Example 4 except for changing the amount of the charge transport material to 40 parts. The results are shown in Table 1.

Example 6

A photoreceptor was produced and evaluated in the same manner as in Example 4 except for changing the amount of the charge transport material to 50 parts. The results are shown in Table 1.

Example 11

A photoreceptor was produced and evaluated in the same manner as in Example 10 except for changing the amount of the charge transport material to 40 parts. The results are shown in Table 1.

Example 12

A photoreceptor was produced and evaluated in the same manner as in Example 10 except for changing the amount of the charge transport material to 50 parts. The results are shown in Table 1.

Example 13

A photoreceptor was produced and evaluated in the same manner as in Example 10 except for changing the charge transport material to (1)-10. The results are shown in Table 1.

Example 14

A photoreceptor was produced and evaluated in the same manner as in Example 13 except for changing the amount of the charge transport material to 40 parts. The results are shown in Table 1.

Example 15

A photoreceptor was produced and evaluated in the same manner as in Example 13 except for changing the amount of the charge transport material to 50 parts. The results are shown in Table 1.

Example 16

A photoreceptor was produced and evaluated in the same manner as in Example 10 except for changing the charge transport material to (2)-7. The results are shown in Table 1.

Example 17

A photoreceptor was produced and evaluated in the same manner as in Example 16 except for changing the amount of the charge transport material to 40 parts. The results are shown in Table 1.

Example 18

A photoreceptor was produced and evaluated in the same manner as in Example 16 except for changing the amount of the charge transport material to 50 parts. The results are shown in Table 1.

Example 19

A photoreceptor was produced and evaluated in the same manner as in Example 1 except for changing the charge transport material to Compound (1)-4. The results are shown in Table 1.

Example 20

A photoreceptor was produced and evaluated in the same manner as in Example 1 except for changing the charge transport material to Compound (2)-8. The results are shown in Table 1.

Example 21

A photoreceptor was produced and evaluated in the same manner as in Example 1 except for changing the charge transport material to Compound (2)-11. The results are shown in Table 1.

Example 22

A photoreceptor was produced and evaluated in the same manner as in Example 1 except for changing the charge transport material to Compound (1)-19. The results are shown in Table 1.

Example 23

A photoreceptor was produced and evaluated in the same manner as in Example 1 except for changing the amount of the charge transport material to 60 parts. The results are shown in Table 1.

Comparative Example 1

A photoreceptor was produced and evaluated in the same manner as in Example 1 except for changing the charge transport material to Compound CT-1 shown below. The results are shown in Table 1.

CT-1

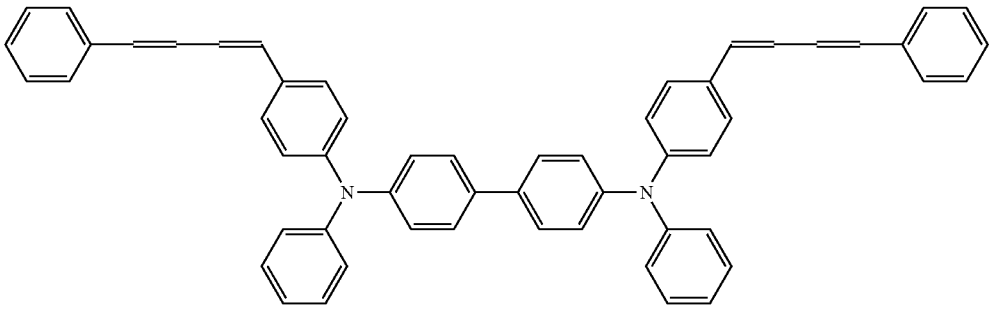

Comparative Example 2

A photoreceptor was produced and evaluated in the same manner as in Comparative Example 1 except for changing the amount of the charge transport material to 40 parts. The results are shown in Table 1.

Comparative Example 3

A photoreceptor was produced and evaluated in the same manner as in Comparative Example 1 except for changing the amount of the charge transport material to 50 parts. The results are shown in Table 1.

Comparative Example 4

A photoreceptor was produced and evaluated in the same manner as in Comparative Example 1 except for using, as the binder resin, PC-2 in place of PC-1. The results are shown in Table 1.

Comparative Example 5

A photoreceptor was produced and evaluated in the same manner as in Comparative Example 4 except for changing the amount of the charge transport material to 40 parts. The results are shown in Table 1.

Comparative Example 6

A photoreceptor was produced and evaluated in the same manner as in Comparative Example 4 except for changing the amount of the charge transport material to 50 parts. The results are shown in Table 1.

Comparative Example 7

A photoreceptor was produced and evaluated in the same manner as in Example 1 except for changing the charge transport material to Compound CT-2 shown below. The results are shown in Table 1.

CT-2

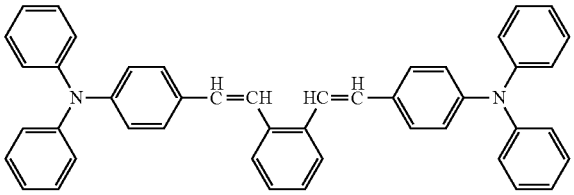

Comparative Example 8

A photoreceptor was produced and evaluated in the same manner as in Comparative Example 7 except for changing the amount of the charge transport material to 40 parts. The results are shown in Table 1.

Comparative Example 9

A photoreceptor was produced and evaluated in the same manner as in Comparative Example 7 except for changing the amount of the charge transport material to 50 parts. The results are shown in Table 1.

Comparative Example 10

A photoreceptor was produced and evaluated in the same manner as in Example 1 except for changing the charge transport material to Compound CT-3 shown below. The results are shown in Table 1.

CT-3

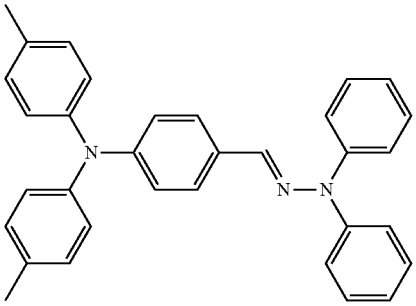

Comparative Example 11

A photoreceptor was produced and evaluated in the same manner as in Comparative Example 10 except for changing the amount of the charge transport material to 40 parts. The results are shown in Table 1.

Comparative Example 12

A photoreceptor was produced and evaluated in the same manner as in Comparative Example 10 except for changing the amount of the charge transport material to 50 parts. The results are shown in Table 1.

Comparative Example 13

A photoreceptor was produced and evaluated in the same manner as in Example 1 except for changing the charge transport material to CT-4 shown below. The results are shown in Table 1.

CT-4

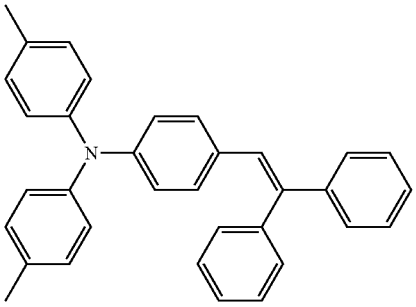

Comparative Example 14

A photoreceptor was produced and evaluated in the same manner as in Comparative Example 13 except for changing the amount of the charge transport material to 40 parts. The results are shown in Table 1.

Comparative Example 15

A photoreceptor was produced and evaluated in the same manner as in Comparative Example 13 except for changing the amount of the charge transport material to 50 parts. The results are shown in Table 1.

Comparative Example 16

A photoreceptor was produced and evaluated in the same manner as in Example 1 except for changing the charge transport material to Compound CT-5 shown below. The results are shown in Table 1.

CT-5

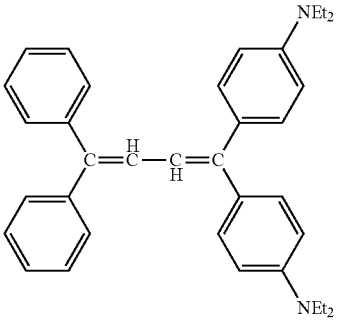

Comparative Example 17

A photoreceptor was produced and evaluated in the same manner as in Comparative Example 16 except for changing the amount of the charge transport material to 40 parts. The results are shown in Table 1.

Comparative Example 18

A photoreceptor was produced and evaluated in the same manner as in Comparative Example 16 except for changing the amount of the charge transport material to 50 parts. The results are shown in Table 1.

Comparative Example 19

A photoreceptor was produced and evaluated in the same manner as in Example 1 except for changing the charge transport material to Compound CT-6 shown below. The results are shown in Table 1.

CT-6

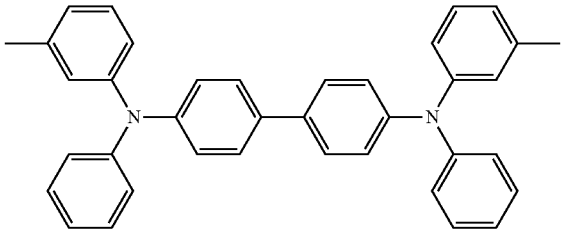

Comparative Example 20

A photoreceptor was produced and evaluated in the same manner as in Comparative Example 19 except for changing the amount of the charge transport material to 40 parts. The results are shown in Table 1.

Comparative Example 21

A photoreceptor was produced and evaluated in the same manner as in Comparative Example 19 except for changing the amount of the charge transport material to 50 parts. The results are shown in Table 1.

Comparative Example 22

A photoreceptor was produced and evaluated in the same manner as in Comparative Example 19 except for changing the amount of the charge transport material to 70 parts. The results are shown in Table 1.

Comparative Example 23

A photoreceptor was produced and evaluated in the same manner as in Comparative Example 19 except for changing the amount of the charge transport material to 100 parts. The results are shown in Table 1.

Comparative Example 24

In Example 1, the coating solution for charge transport layer was prepared by using, as the binder resin, bisphenol-A-polycarbonate (viscosity average molecular weight: 20,000) in place of PC-1, but the coating solution yielded a white turbidity (gelation) the following day and could not be coated.

Comparative Example 31

A photoreceptor was produced and evaluated in the same manner as in Example 1 except that in Example 1, bisphenol-A-polycarbonate (PC-3, viscosity average molecular weight: 20,000) was used in pace of PC-1 as the binder resin and dioxolane was used in place of THF/toluene as the solvent. The results are shown in Table 1.

TABLE 1

| | Charge Transport Material | Parts | Binder Resin | E1/2 (μJ/cm$^2$) | VL (−V) | ΔVL (−V) | ΔVO (V) | Tabor (mg) |
|---|---|---|---|---|---|---|---|---|
| Example 1 | (1)-7 | 30 | PC-1 | 0.085 | 85 | 20 | 72 | 5.0 |
| Example 2 | (1)-7 | 40 | PC-1 | 0.084 | 63 | 13 | | 6.7 |
| Example 3 | (1)-7 | 50 | PC-1 | 0.082 | 50 | 8 | 60 | 7.5 |
| Example 4 | (1)-10 | 30 | PC-1 | 0.087 | 92 | 18 | 84 | 4.0 |
| Example 5 | (1)-10 | 40 | PC-1 | 0.086 | 68 | 19 | | 5.9 |
| Example 6 | (1)-10 | 50 | PC-1 | 0.086 | 56 | 10 | 65 | 8.1 |
| Example 7 | (2)-7 | 30 | PC-1 | 0.093 | 103 | 24 | 58 | 3.9 |
| Example 8 | (2)-7 | 40 | PC-1 | 0.090 | 81 | 12 | | 5.8 |

TABLE 1-continued

| | Charge Transport Material | Parts | Binder Resin | E1/2 (μJ/cm$^2$) | VL (−V) | ΔVL (−V) | ΔVO (V) | Tabor (mg) |
|---|---|---|---|---|---|---|---|---|
| Example 9 | (2)-7 | 50 | PC-1 | 0.091 | 67 | 18 | 40 | 7.8 |
| Example 10 | (1)-7 | 30 | PC-2 | 0.086 | 86 | 22 | 78 | 4.6 |
| Example 11 | (1)-7 | 40 | PC-2 | 0.086 | 61 | 7 | | 5.6 |
| Example 12 | (1)-7 | 50 | PC-2 | 0.084 | 49 | 11 | 62 | 8.5 |
| Example 13 | (1)-10 | 30 | PC-2 | 0.087 | 90 | 22 | 69 | 3.7 |
| Example 14 | (1)-10 | 40 | PC-2 | 0.087 | 65 | 14 | | 5.5 |
| Example 15 | (1)-10 | 50 | PC-2 | 0.085 | 53 | 6 | 57 | 7.6 |
| Example 16 | (2)-7 | 30 | PC-2 | 0.091 | 113 | 27 | 48 | 6.7 |
| Example 17 | (2)-7 | 40 | PC-2 | 0.092 | 77 | 20 | | 6.1 |
| Example 18 | (2)-7 | 50 | PC-2 | 0.092 | 65 | 17 | 31 | 5.5 |
| Example 19 | (1)-4 | 30 | PC-1 | 0.085 | 84 | 18 | 55 | 5.2 |
| Example 20 | (2)-8 | 30 | PC-1 | 0.094 | 105 | 23 | 45 | 4.7 |
| Example 21 | (2)-11 | 30 | PC-1 | 0.096 | 122 | 19 | 40 | 4.3 |
| Example 22 | (1)-19 | 30 | PC-1 | 0.098 | 117 | 25 | 70 | 3.8 |
| Example 23 | (1)-7 | 60 | PC-1 | 0.080 | 44 | 4 | 62 | 9.2 |
| Comparative Example 1 | CT-1 | 30 | PC-1 | 0.088 | 119 | 120 | | 5.2 |
| Comparative Example 2 | CT-1 | 40 | PC-1 | 0.096 | 87 | 97 | | 6.3 |
| Comparative Example 3 | CT-1 | 50 | PC-1 | 0.096 | 68 | 54 | 135 | 12.0 |
| Comparative Example 4 | CT-1 | 30 | PC-2 | 0.090 | 115 | 145 | | 4.1 |
| Comparative Example 5 | CT-1 | 40 | PC-2 | 0.090 | 89 | 81 | | 6.3 |
| Comparative Example 6 | CT-1 | 50 | PC-2 | 0.086 | 77 | 39 | | 6.9 |
| Comparative Example 7 | CT-2 | 30 | PC-1 | 0.091 | 110 | 95 | | 5.3 |
| Comparative Example 8 | CT-2 | 40 | PC-1 | 0.089 | 83 | 62 | | 7.7 |
| Comparative Example 9 | CT-2 | 50 | PC-1 | 0.085 | 69 | 33 | 145 | 9.8 |
| Comparative Example 10 | CT-3 | 30 | PC-1 | 0.080 | 148 | 87 | | 5.0 |
| Comparative Example 11 | CT-3 | 40 | PC-1 | 0.078 | 84 | 52 | | 7.0 |
| Comparative Example 12 | CT-3 | 50 | PC-1 | 0.078 | 56 | 21 | 100 | 8.5 |
| Comparative Example 13 | CT-4 | 30 | PC-1 | 0.084 | 171 | 119 | | 6.5 |
| Comparative Example 14 | CT-4 | 40 | PC-1 | 0.078 | 114 | 89 | | 7.0 |
| Comparative Example 15 | CT-4 | 50 | PC-1 | 0.077 | 86 | 77 | 40 | 10.9 |
| Comparative Example 16 | CT-5 | 30 | PC-1 | 0.094 | 184 | 87 | | 6.1 |
| Comparative Example 17 | CT-5 | 40 | PC-1 | 0.086 | 104 | 60 | | 6.9 |
| Comparative Example 18 | CT-5 | 50 | PC-1 | 0.085 | 57 | 30 | 85 | 10.1 |
| Comparative Example 19 | CT-6 | 30 | PC-1 | 0.108 | 284 | 38 | | 6.7 |
| Comparative Example 20 | CT-6 | 40 | PC-1 | 0.081 | 153 | 19 | | 7.4 |
| Comparative Example 21 | CT-6 | 50 | PC-1 | 0.080 | 106 | 12 | 80 | 9.4 |
| Comparative Example 22 | CT-6 | 70 | PC-1 | 0.078 | 93 | 15 | 108 | 12.5 |
| Comparative Example 23 | CT-6 | 100 | PC-1 | 0.077 | 91 | 13 | 120 | 17.7 |
| Comparative Example 31 | (1)-7 | 30 | PC-3 | 0.086 | 94 | 47 | 121 | 4.8 |

As seen from Table 1, in the photoreceptors of Examples, the initial bright voltage (VL) was low and the ΔVL value was not greatly increased even after repetition. Also, since the charge potential is not significantly reduced even upon application of a positive voltage, it is evident that the photoreceptor exhibits good performance in terms of image stability. Furthermore, it is seen that although a smaller content of the charge transport material is advantageous in view of abrasion resistance but disadvantageous to electrical characteristics, in Examples, even when the content of the charge transport material is small as compared with Comparative Examples, sufficient electrical characteristics and abrasion resistance are obtained.

In addition, it is understood that even when the same charge transport material is used, in Examples using a copolymerized polycarbonate resin having repeating units represented by formulae (3) and (4), the photoreceptor has sufficient electrical characteristics and abrasion resistance as compared with Comparative Examples.

Example 24

<Production of Photoreceptor Drum>

The coating solution for subbing layer formation, the coating solution for charge generation layer formation, and the coating solution for charge transport layer formation each used in Example 1 were successively coated by a dip coating method on an aluminum-made cylinder having a mirror-finished and cleaned surface and having an outer diameter of 30 mm, a length of 260.5 mm and a wall thickness of 0.75 mm, and dried to form a subbing layer, a charge generation layer and a charge transport layer having a dry thickness of 1.3 μm, 0.4 μm, and 25 μm, respectively, whereby a photoreceptor drum was obtained. Incidentally, the drying of the charge transport layer was performed at 125° C. for 20 minutes.

<Image Test>

The photoreceptor drum produced was loaded in a process cartridge for cyan color of a color printer HP Color LaserJet 4700 do (cleaning blade, counter contact type) manufactured by Hewlett-Packard Co., and the cartridge was mounted on the printer. Image formation on 10,000 sheets was performed in an environment at a temperature of 25° C. and a humidity of 50%, and the image defect due to image memory (ghost), fogging, density reduction, filming, scratch or the like was evaluated. The results are shown in Table 2. Incidentally, also in the case of using a process cartridge for each of black, yellow and magenta colors, the same results were obtained.

Example 25

A photoreceptor drum was produced and subjected to an image test in the same manner as in Example 24 except that in Example 24, the coating solution for charge transport layer formation was replaced by that used in Example 4. The results are shown in Table 2.

Example 26

A photoreceptor drum was produced and subjected to an image test in the same manner as in Example 24 except that in Example 24, the coating solution for charge transport layer formation was replaced by that used in Example 7. The results are shown in Table 2.

Example 27

A photoreceptor drum was produced and subjected to an image test in the same manner as in Example 24 except that in Example 24, the coating solution for charge transport layer formation was replaced by that used in Example 10. The results are shown in Table 2.

Example 28

A photoreceptor drum was produced and subjected to an image test in the same manner as in Example 24 except that in Example 24, the coating solution for charge transport layer formation was replaced by that used in Example 13. The results are shown in Table 2.

Example 29

A photoreceptor drum was produced and subjected to an image test in the same manner as in Example 24 except that in Example 24, the coating solution for charge transport layer formation was replaced by that used in Example 16. The results are shown in Table 2.

Example 30

A photoreceptor drum was produced and subjected to an image test in the same manner as in Example 24 except that in Example 24, the coating solution for charge transport layer formation was replaced by that used in Example 19. The results are shown in Table 2.

Example 31

A photoreceptor drum was produced and subjected to an image test in the same manner as in Example 24 except that in Example 24, the coating solution for charge transport layer formation was replaced by that used in Example 20. The results are shown in Table 2.

Example 32

A photoreceptor drum was produced and subjected to an image test in the same manner as in Example 24 except that in Example 24, the coating solution for charge transport layer formation was replaced by that used in Example 21. The results are shown in Table 2.

Example 33

A photoreceptor drum was produced and subjected to an image test in the same manner as in Example 24 except that in Example 24, the coating solution for charge transport layer formation was replaced by that used in Example 22. The results are shown in Table 2.

Example 34

A photoreceptor drum was produced and subjected to an image test in the same manner as in Example 24 except that in Example 24, the coating solution for charge transport layer formation was replaced by that used in Example 23. The results are shown in Table 2.

Comparative Example 25

A photoreceptor drum was produced and subjected to an image test in the same manner as in Example 24 except that in Example 24, the coating solution for charge transport layer formation was replaced by that used in Comparative Example 1. The results are shown in Table 2.

Comparative Example 26

A photoreceptor drum was produced and subjected to an image test in the same manner as in Example 24 except that in Example 24, the coating solution for charge transport layer formation was replaced by that used in Comparative Example 7. The results are shown in Table 2.

Comparative Example 27

A photoreceptor drum was produced and subjected to an image test in the same manner as in Example 24 except that in Example 24, the coating solution for charge transport layer formation was replaced by that used in Comparative Example 12. The results are shown in Table 2.

Comparative Example 28

A photoreceptor drum was produced and subjected to an image test in the same manner as in Example 24 except that in Example 24, the coating solution for charge transport layer formation was replaced by that used in Comparative Example 15. The results are shown in Table 2.

Comparative Example 29

A photoreceptor drum was produced and subjected to an image test in the same manner as in Example 24 except that in Example 24, the coating solution for charge transport layer formation was replaced by that used in Comparative Example 18. The results are shown in Table 2.

Comparative Example 30

A photoreceptor drum was produced and subjected to an image test in the same manner as in Example 24 except that in Example 24, the coating solution for charge transport layer formation was replaced by that used in Comparative Example 21. The results are shown in Table 2.

Comparative Example 33

A photoreceptor drum was produced and subjected to an image test in the same manner as in Example 24 except that in Example 24, the coating solution for charge transport layer formation was replaced by that used in Comparative Example 31. The results are shown in Table 2.

TABLE 2

| | Charge Transport Material | Parts | Binder Resin | Image Quality |
|---|---|---|---|---|
| Example 24 | (1)-7 | 30 | PC-1 | Good |
| Example 25 | (1)-10 | 30 | PC-1 | Good |
| Example 26 | (2)-7 | 30 | PC-1 | Good (slightly low image density) |
| Example 27 | (1)-7 | 30 | PC-2 | Good |
| Example 28 | (1)-10 | 30 | PC-2 | Good |
| Example 29 | (2)-7 | 30 | PC-2 | Good (slightly low image density) |
| Example 30 | (1)-4 | 30 | PC-1 | Good |
| Example 31 | (2)-8 | 30 | PC-1 | Good (slightly low image density) |
| Example 32 | (2)-11 | 30 | PC-1 | Good (slightly low image density) |
| Example 33 | (1)-19 | 30 | PC-1 | Good (slightly low image density) |
| Example 34 | (1)-26 | 30 | PC-1 | Good (slightly low image density) |
| Comparative Example 25 | CT-1 | 30 | PC-1 | Low image density, generation of negative memory |
| Comparative Example 26 | CT-2 | 30 | PC-1 | low image density, generation of negative memory and fogging |
| Comparative Example 27 | CT-3 | 50 | PC-1 | Low image density |
| Comparative Example 28 | CT-4 | 50 | PC-1 | Low image density |
| Comparative Example 29 | CT-5 | 50 | PC-1 | Low image density, generation of fogging |
| Comparative Example 30 | CT-6 | 50 | PC-1 | Low image density |
| Comparative Example 33 | (1)-7 | 30 | PC-3 | Image failure (streak defect due to abrasion of photosensitive layer; memory, fogging) |

It is seen from Table 2 that in Examples, an image memory is less likely to occur compared with Comparative Examples and in turn, a good image is obtained. This application is based on Japanese patent application JP 2011-184858, filed on Aug. 26, 2011, the entire content of which is hereby incorporated by reference, the same as if set forth at length.

What is claimed is:

1. An electrophotographic photoreceptor comprising a photosensitive layer containing at least one charge transport material represented by the following formula (1) or (2) and a copolymerized polycarbonate resin having repeating units represented by the following formulae (3) and (4):

(1)

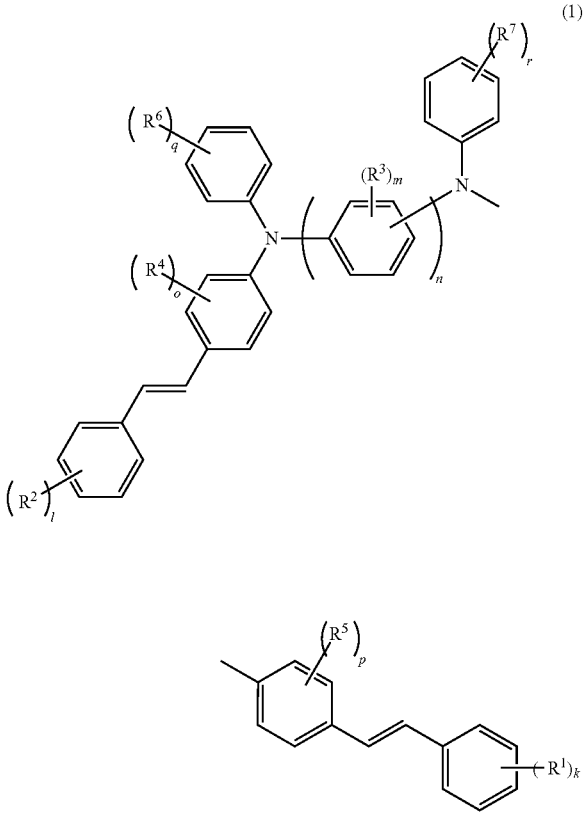

wherein each of $R^1$ to $R^7$ independently represents a hydrogen atom, an alkyl group, an aryl group or an alkoxy group, n represents an integer of 1 to 3, each of k, l, q and r independently represents an integer of 1 to 5, and each of m, o and p independently represents an integer of 1 to 4;

(2)

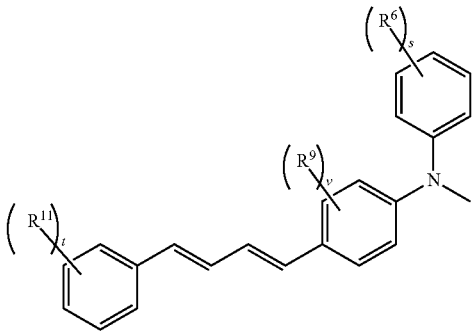

-continued

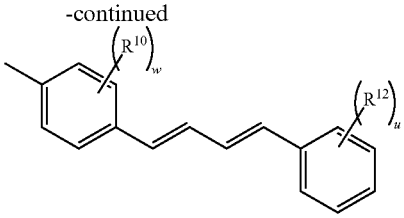

wherein each of $R^8$ to $R^{12}$ independently represents a hydrogen atom, an alkyl group, an aryl group or an alkoxy group, each of s, t and u represents an integer of 1 to 5, and eachof v and w represents an integer of 1 to 4;

(3)

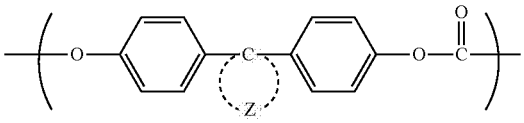

wherein Z forms a cyclic saturated aliphatic alkyl group having a carbon number of 5 to 8 including the carbon atom bonded thereto, and the cyclic saturated aliphatic alkyl group has from 1 to 3 methyl groups as the substituent;

(4)

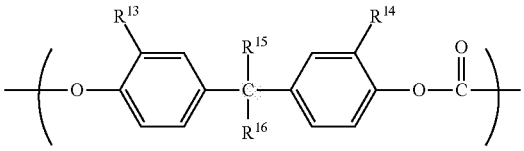

wherein each of $R^{13}$ to $R^{16}$ independently represents a hydrogen atom or a methyl group.

2. The electrophotographic photoreceptor as claimed in claim 1, wherein said copolymerized polycarbonate resin is represented by the following structural formula (5):

(5)

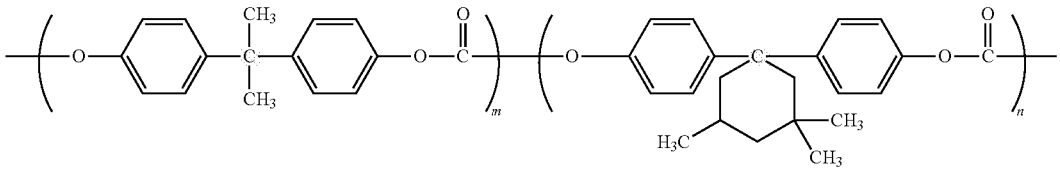

wherein m and n represent a molar ratio, and m:n =from 90:10 to 10:90.

3. The electrophotographic photoreceptor as claimed in claim 1, wherein the amount of said charge transport material used is from 20 to 70 parts by mass per 100 parts by mass of said copolymerized polycarbonate resin.

4. An image-forming apparatus forming an image by using the electrophotographic photoreceptor claimed in claim 1, the image-forming apparatus comprising: a charging portion of charging the electrophotographic photoreceptor; an exposure portion of exposing said charged electrophotographic photoreceptor to light to form an electrostatic latent image; a development portion of developing said electrostatic latent image with a toner; a transfer portion of transferring said toner to a receiving object; and a cleaning portion.

5. An electrophotographic cartridge comprising the electrophotographic photoreceptor claimed in claim 1.

6. The electrophotographic photoreceptor as claimed in claim 1, wherein the charge transport material represented by formula (1) is present.

7. The electrophotographic photoreceptor as claimed in claim 1, wherein the charge transport material represented by formula (2) is present.

8. The electrophotographic photoreceptor as claimed in claim 1, wherein the copolymerization ratio between formula (3) and formula (4) is, in terms of (3):(4), 10:90 to 90:10.

9. The electrophotographic photoreceptor as claimed in claim 1, wherein the copolymerization ratio between formula (3) and formula (4) is, in terms of (3):(4), 10:90 to 50:50.

10. The electrophotographic photoreceptor as claimed in claim 1, wherein the copolymerization ratio between formula (3) and formula (4) is, in terms of (3):(4), 15:85 to 40:60.

11. The electrophotographic photoreceptor as claimed in claim 1, wherein formula (3) is formula (3)-5 or formula (3)-6:

(3)-5

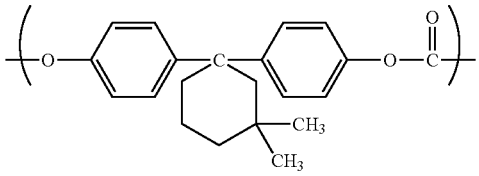

(3)-6

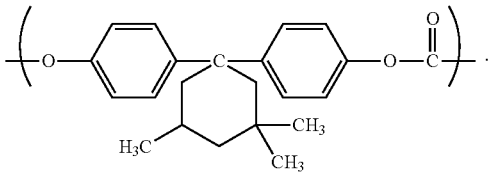

12. The electrophotographic photoreceptor as claimed in claim 1, wherein formula (4) is formula (4)-1 or formula (4)-4:

(4)-1

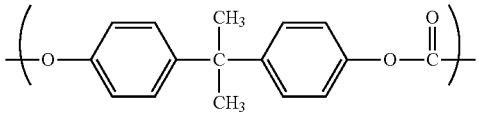

-continued
(4)-4
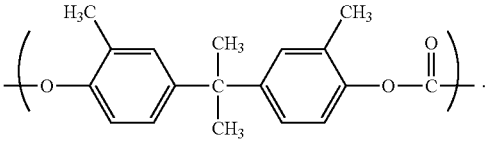
13. The electrophotographic photoreceptor as claimed in claim 11, wherein formula (4) is formula (4)-1 or formula (4)-4:
(4)-1
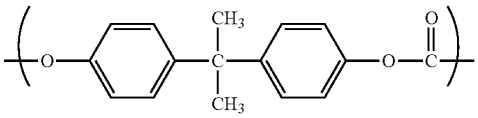
(4)-4
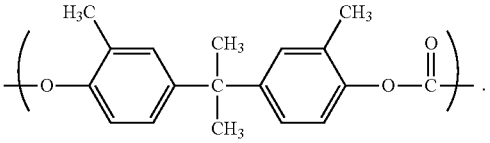
14. The electrophotographic photoreceptor as claimed in claim 1, wherein formula (3) is formula (3)-6, and formula (4) is formula (4)-1:
(3)-6
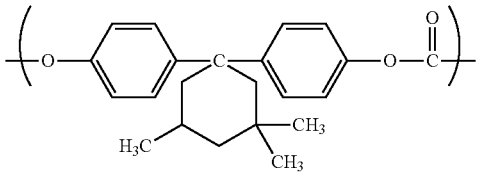
(4)-1
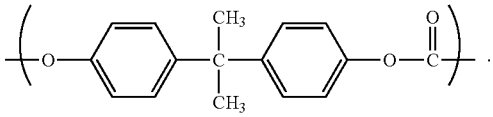
* * * * *